US010192568B2

(12) United States Patent
Wang et al.

(10) Patent No.: US 10,192,568 B2
(45) Date of Patent: Jan. 29, 2019

(54) AUDIO SOURCE SEPARATION WITH LINEAR COMBINATION AND ORTHOGONALITY CHARACTERISTICS FOR SPATIAL PARAMETERS

(71) Applicant: Dolby Laboratories Licensing Corporation, San Francisco, CA (US)

(72) Inventors: Jun Wang, Beijing (CN); David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/543,938

(22) PCT Filed: Feb. 12, 2016

(86) PCT No.: PCT/US2016/017681

§ 371 (c)(1),
(2) Date: Jul. 14, 2017

(87) PCT Pub. No.: WO2016/130885

PCT Pub. Date: Aug. 18, 2016

(65) Prior Publication Data

US 2017/0365273 A1 Dec. 21, 2017

Related U.S. Application Data

(60) Provisional application No. 62/136,849, filed on Mar. 23, 2015.

(30) Foreign Application Priority Data

Feb. 15, 2015 (CN) ..... 2015 1 0082792

(51) Int. Cl.

| | |
|---|---|
| ***G10L 21/0272*** | (2013.01) |
| ***G10L 21/0308*** | (2013.01) |
| ***G10L 25/21*** | (2013.01) |

(52) U.S. Cl.
CPC ..... *G10L 21/0272* (2013.01); *G10L 25/21* (2013.01)

(58) Field of Classification Search
CPC ..... G10L 21/0272; G10L 21/028; G10L 21/0308; G10L 2021/02166; H04R 3/005
(Continued)

(56) References Cited

U.S. PATENT DOCUMENTS 7,127,071 B2 * 10/2006 Rui ..... G10L 21/0272 381/92
7,295,972 B2 11/2007 Choi
(Continued)

FOREIGN PATENT DOCUMENTS

| | | |
|---|---|---|
| EP | 2012555 | 1/2009 |
| GB | 2516483 | 1/2015 |

(Continued)

OTHER PUBLICATIONS

Benaroya L. et al., "Wiener Based Source Separation with HMM/GMM using a single sensor", 4th International Symposium on Independent Component Analysis and Blind Signal Separation (ICA2003), pp. 957-961, Apr. 2003.
(Continued)

*Primary Examiner* — Martin Lerner

(57) ABSTRACT

A method of audio source separation from audio content is disclosed. The method includes determining a spatial parameter of an audio source based on a linear combination characteristic of the audio source and an orthogonality characteristic of two or more audio sources to be separated in the audio content. The method also includes separating the audio source from the audio content based on the spatial parameter. Corresponding system and computer program product are also disclosed.

22 Claims, 15 Drawing Sheets

(58) Field of Classification Search
USPC ..... 704/204, 205, 500, 501, 216; 381/307
See application file for complete search history.

(56) References Cited

U.S. PATENT DOCUMENTS

| | | | | |
|---|---|---|---|---|
| 7,751,572 | B2 | 7/2010 | Villemoes | |
| 8,107,631 | B2 | 1/2012 | Merimaa | |
| 8,144,896 | B2 * | 3/2012 | Liu | G10L 21/0272 381/94.3 |
| 8,213,641 | B2 | 7/2012 | Faller | |
| 8,239,052 | B2 | 8/2012 | Itoyama | |
| 8,280,744 | B2 | 10/2012 | Hellmuth | |
| 8,380,331 | B1 | 2/2013 | Smaragdis | |
| 8,724,829 | B2 | 5/2014 | Visser | |
| 9,558,762 | B1 * | 1/2017 | Sieracki | G10L 15/02 |
| 9,786,288 | B2 * | 10/2017 | Hu | G10L 19/008 |
| 2005/0276420 | A1 | 12/2005 | Davis | |
| 2007/0154033 | A1 * | 7/2007 | Attias | H04R 3/005 381/94.1 |
| 2010/0138010 | A1 | 6/2010 | Aziz Sbai | |
| 2010/0183158 | A1 | 7/2010 | Haykin | |
| 2011/0058685 | A1 * | 3/2011 | Sagayama | G10L 21/0272 381/98 |
| 2011/0078224 | A1 * | 3/2011 | Wilson | G10L 25/48 708/401 |
| 2011/0235823 | A1 | 9/2011 | Betts | |
| 2013/0010968 | A1 * | 1/2013 | Yagi | G10L 21/028 381/17 |
| 2013/0022206 | A1 | 1/2013 | Thiergart | |
| 2013/0070927 | A1 | 3/2013 | Harma | |
| 2013/0294608 | A1 | 11/2013 | Yoo | |
| 2013/0297296 | A1 * | 11/2013 | Yoo | G10L 21/0272 704/203 |
| 2013/0297298 | A1 * | 11/2013 | Yoo | G10L 21/0272 704/205 |
| 2013/0338806 | A1 * | 12/2013 | LaRosa | G10L 21/0272 700/94 |
| 2014/0058736 | A1 | 2/2014 | Taniguchi | |
| 2014/0201630 | A1 * | 7/2014 | Bryan | G10L 21/0272 715/716 |
| 2014/0226838 | A1 | 8/2014 | Wingate | |
| 2014/0286497 | A1 | 9/2014 | Thyssen | |
| 2014/0316771 | A1 | 10/2014 | Short | |
| 2015/0025880 | A1 * | 1/2015 | Le Roux | G10L 21/0208 704/233 |
| 2015/0242180 | A1 * | 8/2015 | Boulanger-Lewandowski | G06N 3/0445 700/94 |
| 2015/0365766 | A1 * | 12/2015 | Cho | G10L 21/0272 381/17 |
| 2016/0073198 | A1 * | 3/2016 | Vilermo | G10L 21/028 381/26 |
| 2016/0125893 | A1 * | 5/2016 | Le Magoarou | G10L 21/0272 704/204 |
| 2016/0189730 | A1 * | 6/2016 | Du | G10L 21/0272 704/233 |
| 2016/0267914 | A1 * | 9/2016 | Hu | G10L 19/008 |
| 2017/0206907 | A1 * | 7/2017 | Wang | G10L 19/008 |

FOREIGN PATENT DOCUMENTS

| | | |
|---|---|---|
| JP | 2010-049083 | 3/2010 |
| WO | 2014/147442 | 9/2014 |
| WO | 2016/011048 | 1/2016 |

OTHER PUBLICATIONS

Fevotte C. et al., "Nonnegative matrix factorization with the Itakura-Saito divergence with application to music analysis", Neural Computation, vol. 21, No. 3, pp. 793-830, Mar. 2009.

Sawada H. et al., "Underdetermined Convolutive Blind Source Separation via Frequency Bin wise Clustering and Permutation Alignment", IEEE Trans on Audio, Speech and Language Processing, pp. 516-527, May 27, 2010.

Bertin N. et al., "Fast Bayesian NMF Algorithms Enforcing Harmonicity and Temporal Continuity in Polyphonic Music Transcription", IEEE Workshop on Applications of Signal Processing to Audio and Acoustics, pp. 29-32, Oct. 18-21, 2009.

Lefevre A. et al., "Itakura-Saito Nonnegative Matrix Factorization with Group Sparsity", IEEE International Conference on Acoustics, Speech and Signal Processing (ICASSP), pp. 21-24, May 22-27, 2011.

Smaragdis P. et al., "Non-Negative Matrix Factorization for Irregularly-Spaced Transforms", IEEE Workshop for Applications of Signal Processing in Audio and Acoustics, New Paltz, NY, pp. 1-4, Oct. 20-23, 2013.

Ozerov A. et al., "Adaptation of Bayesian Models for Single-Channel Source Separation and its application to Voice/Music Separation in Popular Songs", IEEE Transactions on Audio Speech and Language Processing, vol. 15 No. 5, pp. 1564-1578, Jul. 2007.

Wikipedia, "Purity (quantum mechanics)", (downloaded Jul. 19, 2017).

Wikipedia, "Density Matrix", (downloaded Jul. 19, 2017).

Ozerov, A. et al "Multichannel Nonnegative Matrix Factorization in Convolutive Mixtures for Audio Source Separation" IEEE Transactions on Audio, Speech, and Language Processing, vol. 18, Issue 3, pp. 550-563, Sep. 1, 2009.

Kitamura, D. "Efficient Multichannel Nonnegative Matrix Factorization with rank-1 Spatial Model" IEEE International Conference on Acoustics, Speech and Signal Processing, Apr. 19-24, 2015, pp. 276-280.

* cited by examiner

*Pseudo code 1:*

*Input:* An estimation of the input audio sources' power spectrum matrix $\widehat{\boldsymbol{\Sigma}}_{s,fn} = diag([\widehat{\boldsymbol{C}}_{s,fn}]) = [\widehat{\boldsymbol{\Sigma}}_j]_j$, initialization of $\{\boldsymbol{W}_j, \boldsymbol{H}_j\}$

*Output:* non-negative matrices $\{\boldsymbol{W}_j, \boldsymbol{H}_j\}$ such that $\widehat{\boldsymbol{\Sigma}}_j \approx \boldsymbol{W}_j \boldsymbol{H}_j$

*for* *iter* = 1:iter_NMF, *do:*

$$\boldsymbol{W}_j \leftarrow \boldsymbol{W}_j \frac{(\boldsymbol{W}_j\boldsymbol{H}_j)^{-2}\widehat{\boldsymbol{\Sigma}}_j * \boldsymbol{H}_j^H}{(\boldsymbol{W}_j\boldsymbol{H}_j)^{-1} * \boldsymbol{H}_j^H} \tag{5}$$

$$\boldsymbol{H}_j \leftarrow \boldsymbol{H}_j \frac{\boldsymbol{W}_j^H * \widehat{\boldsymbol{\Sigma}}_j(\boldsymbol{W}_j\boldsymbol{H}_j)^{-2}}{\boldsymbol{W}_j^H * (\boldsymbol{W}_j\boldsymbol{H}_j)^{-1}} \tag{6}$$

*end for*

FIG. 4

*Pseudo code 2:*

*Input:* An estimation of the input audio content's covariance matrix: $\boldsymbol{C}_{X,fn}$, An estimation of power of the noise signal: $\boldsymbol{\Lambda}_{b,f}$, Initialization: $\widehat{\boldsymbol{C}}_{S,fn} \leftarrow [\widehat{\boldsymbol{\Sigma}}_j]_j$, $\widehat{\boldsymbol{D}}_{f,n}$, The count of iterations: *iter_Gradient*

*Output:* Refined parameters: $\widehat{\boldsymbol{C}}_{S,fn}$, $\widehat{\boldsymbol{D}}_{f,n}$, $\widehat{\boldsymbol{\Sigma}}_j$

*for* *iter* = 1:*iter_Gradient*, *do:*

$$\nabla \boldsymbol{D}_{f,n} = \frac{\mu \cdot \left[\widehat{\boldsymbol{D}}_{f,n}\left(\boldsymbol{C}_{X,fn} - \boldsymbol{\Lambda}_{b,f}\right)\widehat{\boldsymbol{D}}_{f,n}^{H} - diag\left(\widehat{\boldsymbol{D}}_{f,n}\left(\boldsymbol{C}_{X,fn} - \boldsymbol{\Lambda}_{b,f}\right)\widehat{\boldsymbol{D}}_{f,n}^{H}\right)\right]\widehat{\boldsymbol{D}}_{f,n}\boldsymbol{C}_{X,fn}}{\left\|\widehat{\boldsymbol{D}}_{f,n}\right\|_F^2 \cdot \left\|\boldsymbol{C}_{X,fn} - \boldsymbol{\Lambda}_{b,f}\right\|_F^2 + \varepsilon} \tag{13}$$

$$\widehat{\boldsymbol{D}}_{f,n} \leftarrow \widehat{\boldsymbol{D}}_{f,n} + \nabla \boldsymbol{D}_{f,n} \tag{14}$$

$$\widehat{\boldsymbol{C}}_{S,fn} \leftarrow \widehat{\boldsymbol{D}}_{f,n}\boldsymbol{C}_{X,fn}\widehat{\boldsymbol{D}}_{f,n}^{H} \tag{15}$$

$$[\widehat{\boldsymbol{\Sigma}}_j]_j \leftarrow diag\left(\widehat{\boldsymbol{D}}_{f,n}\boldsymbol{C}_{X,fn}\widehat{\boldsymbol{D}}_{f,n}^{H}\right) \tag{16}$$

*end for*

FIG. 5

FIG. 14

*Pseudo code 3:*

*Input:* An estimation of the input signals' covariance matrix: $\boldsymbol{C}_{X,fn}$, An estimation of power of the additive noise: $\boldsymbol{\Lambda}_{b,f}$, The count of iterations: *iter_Gradient*, A threshold for convergence measurement: *thr_conv*, A threshold for difference between two consequentiterations: *thr_con _diff*, Initialization: $\widehat{\boldsymbol{C}}_{S,fn} \leftarrow [\widehat{\boldsymbol{\Sigma}}_j]_j$ , $\widehat{\boldsymbol{D}}_{f,n}$,

*Output:* Refined parameters: $\widehat{\boldsymbol{C}}_{S,fn}$, $\widehat{\boldsymbol{D}}_{f,n}$, $\widehat{\boldsymbol{\Sigma}}_j$

*for* *iter* = 1:*iter_Gradient*, *do:*

Calculate Equations (13) to (16);
Calculate convergence measurement:

$$\sigma_{iter} = \frac{\left\|\widehat{\boldsymbol{D}}_{f,n}\boldsymbol{C}_{X,fn}\widehat{\boldsymbol{D}}_{f,n}^{H}\right\|_F}{\left\|\widehat{\boldsymbol{D}}_{f,n}\right\|_F^2 \cdot \left\|\boldsymbol{C}_{X,fn}\right\|_F^2 + \varepsilon} \qquad (21)$$

$$\nabla\sigma = \sigma_{iter-1} - \sigma_{iter} \qquad (22)$$

If ($\sigma_{iter}$ < *thr_conv*) and ($\nabla\sigma$ < *thr_conv_diff*), break the iteration;

*end for*

AUDIO SOURCE SEPARATION WITH LINEAR COMBINATION AND ORTHOGONALITY CHARACTERISTICS FOR SPATIAL PARAMETERS

CROSS REFERENCE TO RELATED APPLICATIONS

This application claims priority to Chinese Patent Application No. 201510082792.6, filed 15 Feb. 2015, and U.S. Provisional Application No. 62/136,849, filed 23 Mar. 2015, each of which is hereby incorporated by reference in its entirety.

TECHNOLOGY

Example embodiments disclosed herein generally relate to audio content processing, and more specifically, to a method and system of audio source separation from audio content.

BACKGROUND

Audio content of multi-channel format (such as stereo, surround 5.1, surround 7.1, and the like) is created by mixing different audio signals in a studio, or generated by recording acoustic signals simultaneously in a real environment. The mixed audio signal or content may include a number of different sources. Source separation is a task to identify information of each of the sources in order to reconstruct the audio content, for example, by a mono signal and metadata including spatial information, spectral information, and the like.

When recording an auditory scene using one or more microphones, it is preferred that audio source dependent information is separated such that it may be suitable for use in a great variety of subsequent audio processing tasks. As used herein, the term "audio source" refers to an individual audio element that exists for a defined duration of time in the audio content. An audio source may be dynamic or static. For example, an audio source may be a human, an animal or any other sound source in a sound field. Some examples of the audio processing tasks may include spatial audio coding, remixing/re-authoring, 3D sound analysis and synthesis, and/or signal enhancement/noise suppression for various purposes (e.g., the automatic speech recognition). Therefore, improved versatility and better performance can be achieved by a successful audio source separation.

When no prior information of the audio sources involved in the capturing process is available (for instance, the properties of the recording devices, the acoustic properties of the room, and the like), the separation process can be called blind source separation (BSS). The blind source separation is relevant to various application areas, for example, speech enhancement with multiple microphones, crosstalk removal in multichannel communications, multipath channel identification and equalization, direction of arrival (DOA) estimation in sensor arrays, improvement over beam-forming microphones for audio and passive sonar, music re-mastering, transcription, object-based coding, or the like.

There is a need in the art for a solution for audio source separation from audio content without prior information.

SUMMARY

In order to address the foregoing and other potential problems, example embodiments disclosed herein propose a method and system of audio source separation from channel-based audio content.

In one aspect, an example embodiment disclosed herein provides a method of audio source separation from audio content. The method includes determining a spatial parameter of an audio source based on a linear combination characteristic of the audio source and an orthogonality characteristic of two or more audio sources to be separated in the audio content. The method also includes separating the audio source from the audio content based on the spatial parameter. Embodiments in this regard further include a corresponding computer program product.

In another aspect, an example embodiment disclosed herein provides a system of audio source separation from audio content. The system includes a joint determination unit configured to determine a spatial parameter of an audio source based on a linear combination characteristic of the audio source and an orthogonality characteristic of two or more audio sources to be separated in the audio content. The system also includes an audio source separation unit configured to separate the audio source from the audio content based on the spatial parameter.

Through the following description, it would be appreciated that in accordance with example embodiments disclosed herein, spatial parameters of audio sources used for audio source separation can be jointly determined based on a linear combination characteristic of the audio source and an orthogonality characteristic of two or more audio sources to be separated in the audio content, such that perceptually natural audio sources are obtained while enabling a stable and rapid convergence. Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments disclosed herein will be illustrated in an example and non-limiting manner, wherein:

FIG. 4 illustrates a schematic diagram of a pseudo code for parameter determination in a iterative process in accordance with an example embodiment disclosed herein;

FIG. 5 illustrates a schematic diagram of another pseudo code for parameter determination in another iterative process in accordance with an example embodiment disclosed herein;

FIG. 14 illustrates a schematic diagram of yet another pseudo code for parameter determination in an iterative process in accordance with an example embodiment disclosed herein;

Throughout the drawings, the same or corresponding reference symbols refer to the same or corresponding parts.

DESCRIPTION OF EXAMPLE EMBODIMENTS

Figure 1:
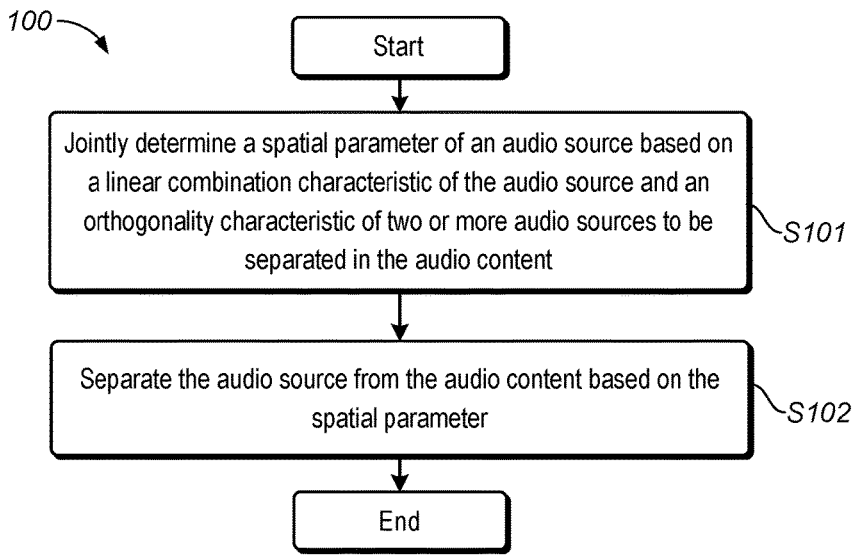
FIG. 1 illustrates a flowchart of a method of audio source separation from audio content in accordance with an example embodiment disclosed herein.

Principles of example embodiments disclosed herein will now be described with reference to various example embodiments illustrated in the drawings. It should be appreciated that depiction of these embodiments is only to enable those skilled in the art to better understand and further implement example embodiments disclosed herein, not intended for limiting the scope disclosed herein in any manner.

As mentioned above, it is desired to separate audio sources from audio content of traditional channel-based formats without prior knowledge. Many techniques in audio source modeling have been generated for addressing the problem of audio source separation. A representative class of techniques is based on an orthogonality assumption of audio sources in the audio content. That is, audio sources contained in the audio content are assumed to be independent or uncorrelated. Some typical methods based on independent/uncorrelated audio source modeling techniques include adaptive de-correlation method, Primary Component Analysis (PCA), and Independent Component Analysis (ICA), and the like. Another representative class of techniques is based on an assumption of a linear combination of a target audio source in the audio content. It allows a linear combination of spectral components of the audio source in frequency domain on the basis of activation of those spectral components in time domain. In this assumption, the audio content is modeled by an additive model. A typical additive source modeling method is Non-negative Matrix Factorization (NMF), which allows the representation of two dimensional non-negative components (spectral components and temporal components) on the basis of the linear combination of meaningful spectral components.

The above described representative classes (i.e., orthogonality assumption and linear combination assumption) have respective advantages and disadvantages in audio processing applications (e.g., re-mastering real-world movie content, separating recordings in real environments).

For example, independent/uncorrelated source models may have stable convergence in computation. However, audio source outputs by these models usually are not sounding perceptually natural, and sometimes the results are meaningless. The reason is that the models fit poorly to realistic sound scenarios. For example, a PCA model is constructed by $D=V^{-1}C_X V$, with a diagonal matrix D, an orthogonal matrix V, and a matrix $C_X$ representing a covariance matrix of input audio signal. This least-squares/Gaussian model may be counter-intuitive for sounds, and it sometimes may give meaningless results by making use of cross-cancellation.

Compared with the independent/uncorrelated source models, the source models based on the linear combination assumption (also referred to as additive source models) have merits that they generate more perceptually pleasing sounds. This is probably because they are related to more perceptual take-on analysis as sounds in the real world are closer to additive models. However, the additive source models have indeterminacy issues. These models may generally only ensure convergence to a stationary point of the objective function, so that they are sensitive to parameter initialization. For some conventional systems where original source information is available for initializations, the additive source models may be sufficient to recover the sources with a reasonable convergence speed. It is not practical for most real-world applications since the initialization information is usually not available. Particularly, for highly non-stationary and varying sources, the convergence may not be available in the additive source models.

It should be appreciated that training data is available for some applications of the additive source models. However, difficulties may arise when employing training data in practice due to the fact that the additive models for the audio sources learned from the training data tend to perform poorly in realistic cases. This is due generally to a mismatch between the additive models and the actual properties of the audio sources in the mix. Without properly matched initializations, this solution may not be effective and in fact may generate sources that are highly correlated to each other which may lead to estimation instability or even divergence. Consequently, the additive modeling methods such as NMF may not be sufficient for a stable and satisfactory convergence for many real-world application scenarios.

Moreover, permutation indeterminacy is a common problem to be addressed for both independent/uncorrelated source modeling methods and additive source modeling methods. The independent/uncorrelated source modeling methods may be applied in each frequency bin, yielding a set of source sub-band estimates per frequency bin. However, it is difficult to identify sub-band estimations pertaining to each separated audio source. Likewise, for an additive source modeling method such as NMF which obtains spectrum component factors, it is difficult to know which spectrum component pertaining to each separated audio source.

In order to improve the performance of audio source separation from channel-based audio content, example embodiments disclosed herein provide a solution for audio source separation by jointly taking advantage of both additive source modeling and independent/uncorrelated source modeling. One possible advantage of the example embodiments may include that perceptually natural audio sources are obtained while enabling a stable and rapid convergence. The solution can be used in any application areas which require audio source separation for mixed signal processing and analysis, such as object-based coding, movie and music re-mastering, Direction of Arrival (DOA) estimation, cross-talk removal in multichannel communications, speech enhancement, multi-path channel identification and equalization, or the like.

Compared with these conventional solutions, some advantages of the proposed solution can be summarized as below:

1) The estimation instabilities or divergence problem of the additive source modeling methods may be overcome. As discussed above, the additive source modeling methods such as NMF are not sufficient to achieve a stable and satisfactory convergence performance in many real-world application conditions. The proposed joint determination solution, on the other hand, exploits an additional criterion which is embedded in independent/uncorrelated source models.
2) The parameter initialization for additive source modeling may be deemphasized. Since the proposed joint determination solution incorporates independence/uncorrelated regularizations, rapid convergence may be achieved, which no longer varies remarkably from different parameter initialization; meanwhile, the final results may not depend strongly on the parameter initialization.
3) The proposed joint determination solution may enable dealing with highly non-stationary sources with stable convergence, including fast moving objects, time-varying sounds, either with or without a training process and oracle initializations.
4) The proposed joint determination solution may get better statistical fit for the audio content than independent/uncorrelated models, by taking advantage of perceptual take-on analysis methods, so it results in better sounding and more meaningful outputs.
5) The proposed joint determination solution has advantages over the factorial methods of independent/uncorrelated models in the sense that the sum of models can be equal to a model of the sum of sounds. Thus it allows versatility to various application scenarios, such as flexible learning of "target" and/or "noise" model, easily adding the temporal dimension constraints/restrictions, applying spatial guidance, user guidance, Time-Frequency guidance, and the like.
6) The proposed joint determination solution may circumvent the permutation issue which exists in both additive modeling methods and independent/uncorrelated modeling methods. It reduces some of the ambiguities inherent in the independence criterion such as frequency permutations, the ambiguities among additive components and degrees of freedom introduced by the conventional source modeling methods.

Detailed description of the proposed solution is given below.

Reference is first made to FIG. 1, which depicts a flowchart of a method 100 of audio source separation from audio content in accordance with an example embodiment disclosed herein.

At S101, a spatial parameter of an audio source is jointly determined based on a linear combination characteristic of the audio source and an orthogonality characteristic of two or more audio sources to be separated in the audio content.

The audio content to be processed may, for example be traditional multi-channel audio content, and may be in a time-frequency-domain representation. The time-frequency-domain representation represents the audio content in terms of a plurality of sub-band signals describing a plurality of frequency bands. For example, an I-channel input audio $x_i(t)$, where (i=1, 2, . . . , I, t=1, 2, . . . T), may be processed in a Short-Time Fourier Transform (STFT) domain to obtain $X_{f,n}=[x_{1,f,n}, \ldots, x_{1,f,n}]$. Unless specifically indicated otherwise herein, i represents an index of a channel, and I represents the number of the channels in the audio content; f represents a frequency bin index, and F represents the total number of frequency bins; and n represents a time frame index, and N represents the total number of time frames.

In one example embodiment, the audio content is modeled by a mixing model, where the audio sources are mixed in the audio content by respective mixing parameters. The remaining signal other than the audio sources is the noise. The mixing model of the audio content may be presented in a matrix form as:

$$X_{f,n}=A_{f,n}s_{f,n}+b_{f,n} \tag{1}$$

where $s_{f,n}=[s_{1,f,n}, \ldots, s_{J,f,n}]$ represents a matrix of J audio sources to be separated, $A_{f,n}=[a_{ij,fn}]_{ij}$ represents a mixing parameter matrix (also referred to as a spatial parameter matrix) of the audio sources in the I channels, and $b_{f,n}=[b_{1,f,n}, \ldots, b_{1,f,n}]$ represents the additive noise. Unless specifically indicated otherwise herein, j represents an index of an audio source and J represents the number of audio source to be separated. It is noted that in some cases, the noise signal may be ignored when modeling the audio content. That is, $b_{f,n}$ may be ignored in Equation (1).

In modeling the audio content, the number of audio sources to be separated may be predetermined. The predetermined number may be of any value, and may be set based on the experience of the user or the analysis of the audio content. In an example embodiment, it may be configured based on the type of the audio content. In another example embodiment, the predetermined number may be larger than one.

Given the above mixing model, the problem of audio source separation may be stated as having the input audio content $X_{f,n}$ observed, how to determine the spatial parameters of the unknown audio sources $A_{f,n}$ that may be frequency-dependent and time-varying. In one example embodiment, an inversion mixing matrix $D_{f,n}$ that inverts $A_{f,n}$ may be introduced in order to directly obtain the separated audio sources via, for example, Wiener filtering, and then estimation of the audio sources $\hat{s}_{f,n}$ which may be determined as follows:

$$\hat{s}_{f,n}=D_{f,n}A_{f,n}s_{f,n}=D_{f,n}(X_{f,n}-b_{f,n}) \tag{2}$$

Since the noise signal may sometimes be ignored or may be estimated based on the input audio content, one important task in audio source separation is to estimate the spatial parameter matrix $A_{f,n}$.

In example embodiments disclosed herein, both the additive source modeling and the independent/uncorrelated source modeling may be taken advantage of to estimate the spatial parameter of the target audio sources to be separated. As mentioned above, the additive source modeling is based on the linear combination characteristic of the target audio source, which may result in perceptually natural sounds. The independent/uncorrelated source modeling is based on the orthogonality characteristic of the multiple audio sources to be separated, which may result in a stable and rapid convergence. In this regard, by jointly determining the spatial parameter based on both of the characteristics, a perceptually natural audio source can be obtained while enabling a stable and rapid convergence.

The linear combination characteristics of the target audio source under consideration and the orthogonality characteristics of the multiple audio sources to be separated, including the target one, may be jointly considered in determining the spatial parameter of the target audio source. In some example embodiments, a power spectrum parameter of the target audio source may be determined based on either a linear combination characteristic or an orthogonality characteristic. Then, the power spectrum parameter may be updated based on the other non-selected characteristic (e.g., linear combination characteristic or orthogonality characteristic). The spatial parameter of the target audio source may be determined based on the updated power spectrum parameter.

In one example embodiment, an additive source model may be used first. As mentioned above, the additive source model is based on the assumption of a linear combination of the target audio source. Some well-known processing algorithms in additive source modeling may be used to obtain parameters of the audio source, such as the power spectrum parameter. Then an independent/uncorrelated source model may be used to update the audio source parameters obtained in the additive source model. In the independent/uncorrelated source model, two or more audio sources, including the target audio source, may be assumed to be statistically independent or uncorrelated with each other and have orthogonality properties. Some well-known processing algorithms in independent/uncorrelated source modeling may be used. In another example embodiment, the independent/uncorrelated source model may be used to determine the audio source parameters first and the additive source model may then be used to update the audio source parameters.

In some example embodiments, the joint determination may be an iterative process. That is, the process of determination and updating described above may be performed iteratively so as to obtain a proper spatial parameter for the audio source. For example, an expectation maximization (EM) iterative process may be used to obtain the spatial parameters. Each iteration of the EM process may include an Expectation step (E step) and a Maximization step (M step).

To avoid confusion of different source parameters, some term definitions are given below:

Principle parameters: the parameters to be estimated and output for describing and/or recovering the audio sources, including the spatial parameters and the spectral parameters of the audio sources;

Intermediate parameters: the parameters calculated for determining the principle parameters, including but not limited to the power spectrum parameters of the audio sources, the covariance matrix of the input audio content, the covariance matrices of the audio sources, the cross covariance matrices of the input audio content and audio sources, the inverse matrix of the covariance matrices, and so on.

The source parameters may refer to both the principle parameters and the intermediate parameters.

In joint determination based on both the independent/uncorrelated source model and the additive source model, the degree of orthogonality may also be restrained by the additive source model. In some example embodiments, a degree of orthogonality control that indicates the orthogonality properties among the audio sources to be separated may be set for the joint determination of the spatial parameters. Therefore, an audio source with perceptually natural sounds as well as a proper degree of orthogonality relative to other audio sources may be obtained based on the spatial parameters. A "proper degree" of orthogonality as used herein is defined as outputting pleasant sounding sources despite a certain acceptable amount of correlation between the audio sources by way of controlling the joint source separation as described below.

It can be appreciated that, for each audio source among the predetermined number of audio sources to be separated, the respective spatial parameter may be obtained accordingly.

Figure 2:
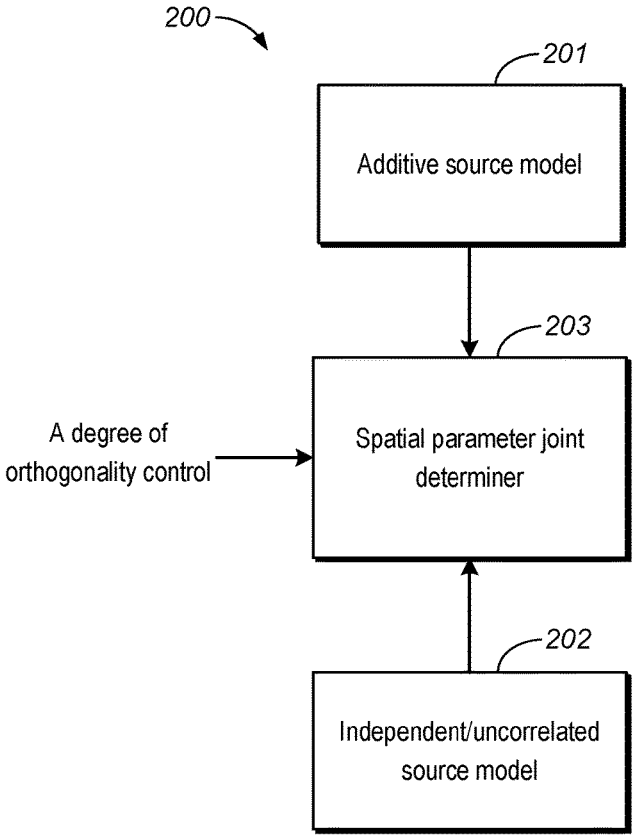
FIG. 2 illustrates a block diagram of a framework for spatial parameter determination in accordance with an example embodiment disclosed herein.

FIG. 2 depicts a block diagram of a framework 200 for spatial parameter determination in accordance with an example embodiment disclosed herein. In the framework 200, an additive source model 201 may be used to estimate intermediate parameters of audio sources, such as the power spectrum parameters, based on respective linear combination characteristics. An independent/uncorrelated source model 202 may be used to update the intermediate parameters of the audio sources based on the orthogonality characteristic. A spatial parameter joint determiner 203 may revoke one of the models 201 and 202 to estimate the intermediate parameters of the audio sources to be separated first, and then revoke the other model to update the intermediate parameters. The spatial parameter joint determiner 203 may then determine the spatial parameters based on the updated intermediate parameters. The processing of the estimation and the updating may be iterative. A degree of orthogonality control may also be provided to the spatial parameter joint determiner 203 so as to control the orthogonality properties among the audio sources to be separated.

The description of spatial parameter determination will be described in detail below.

As indicated in FIG. 1, the method 100 proceeds to S102, where the audio source is separated from the audio content based on the spatial parameter.

As the spatial parameter is determined, the corresponding target audio source may be separated from the audio content. For example, the audio source signal may be obtained according to Equation (2) in the mixing model.

Figure 3:
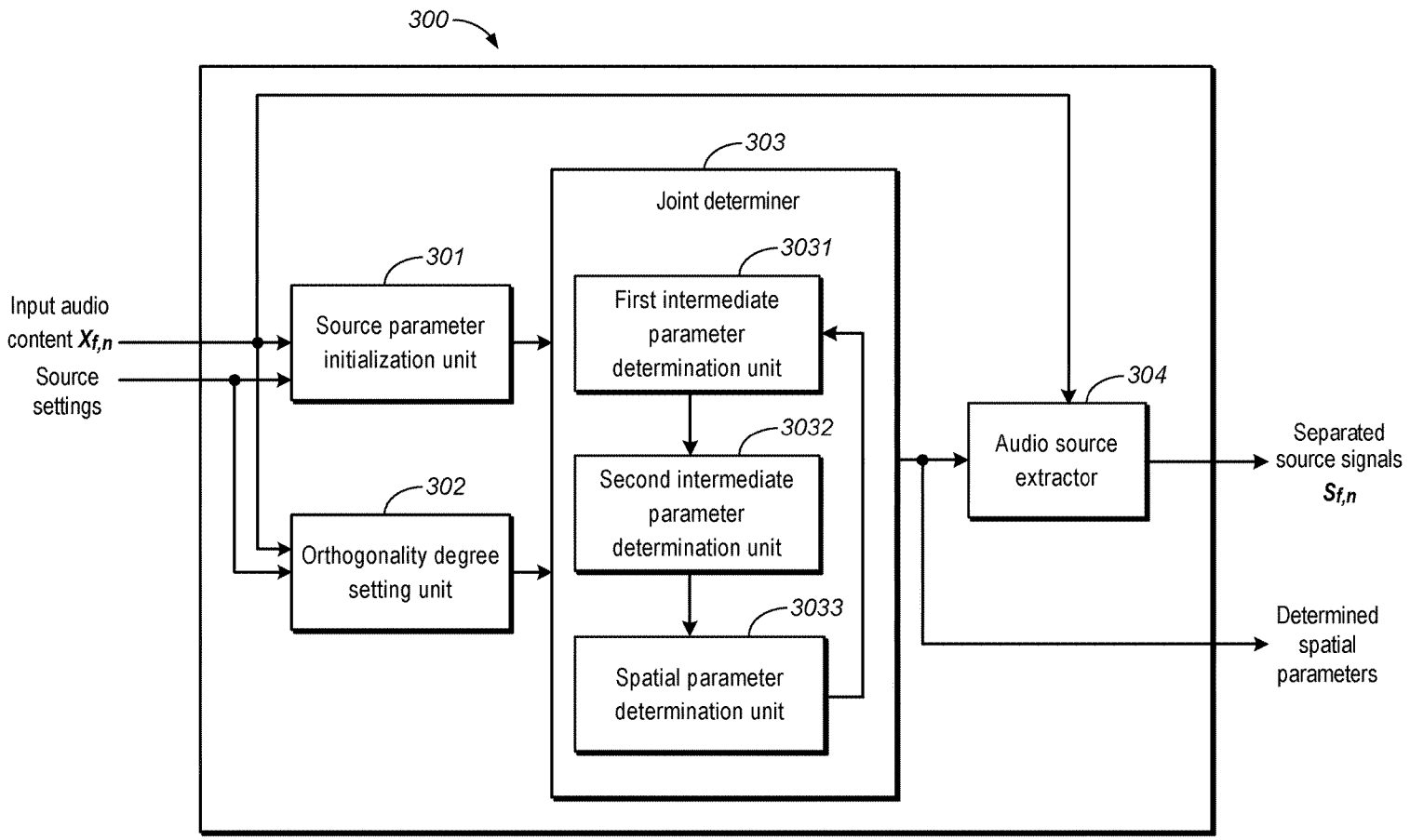
FIG. 3 illustrates a block diagram of a system of audio source separation in accordance with an example embodiment disclosed herein.

Reference is now made to FIG. 3, which depicts a block diagram of a system of audio source separation 300 in accordance with an example embodiment disclosed herein. The method of audio source separation proposed herein may be implemented in the system 300. The system 300 may be configured to receive input audio content in time-frequency-domain representation $X_{f,n}$ and a set of source settings. The set of source settings may include, for example, one or more of a predetermined source number, mobility of the audio sources, stability of the audio sources, a type of audio source mixing and the like. The system 300 may process the audio content, including estimating the spatial parameters, and then output the separated audio sources $s_{f,n}$ and their corresponding parameters, including the spatial parameters $A_{f,n}$.

The system 300 may include a source parameter initialization unit 301 configured to initialize the source parameters, including the spatial parameters, the spectral parameters and the covariance matrix of the audio content that may be used to assist in determining the spatial parameters, and the noise signal. The initialization may be based on the input audio content and the source settings. An orthogonality degree setting unit 302 may be configured to set the orthogonality degree for the joint determination of spatial parameters. The system 300 includes a joint determiner 303 configured to jointly determine the spatial parameters of audio sources based on both of the linear combination characteristic and the orthogonality characteristic. In the joint determiner 303, a first intermediate parameter determination unit 3031 may be configured to estimate the intermediate parameters of the audio sources such as the power spectrum parameters, based on an additive source model or an independent/uncorrelated model. A second intermediate parameter determination unit 3032 included in the joint determiner 303 may be configured based on a different model from the first determination unit 3031, to refine the intermediate parameters estimated in the first determination unit 3031. Then a spatial parameter determination unit 3033 may have the refined intermediate parameters input and determine the spatial parameters of audio sources to be separated. The determination units 3031, 3032, and 3033 may determine the source parameters iteratively, for example, in an EM iterative process, so as to obtain proper spatial parameters for audio source separation. An audio source separator 304 is included in the system 300 and is configured to separate audio sources from the input audio content based on the spatial parameters obtained from the joint determiner 303.

The functionality of the blocks in the system 300 shown in FIG. 3 will be described in more details below.

Source Setting

In some example embodiments, the spatial parameter determination may be based on the source settings. The source settings may include, for example, one or more of a predetermined source number, mobility of the audio sources, stability of the audio sources, a type of audio source mixing and the like. The source settings may be obtained by user input, or by analysis of the audio content.

In one example embodiment, from knowledge of the predetermined source number, an initialized matrix of spatial parameters for the audio sources may be constructed. The predetermined source number may also have effect on processing of spatial parameter determination. For example, supposing that J audio sources are predetermined to be separated from an I-channel audio content, if J>I, the spatial parameter determination may be processed in an underdetermined mode, for example, the signals observed (I channels of audio signals) are less than the signals to be estimated (J audio source signals). Otherwise, the following spatial parameter determination may be processed in an overdetermined mode, for example, the signals observed (I channels of audio signals) are more than the signals to be estimated (J audio source signals).

In one example embodiment, the mobility of the audio sources (also referred to as audio source mobility) may be used for setting if the audio sources are moving or stationary. If a moving source is to be separated, its spatial parameter may be estimated to be time-varying. This setting may determine if the spatial parameters $A_{f,n}$ of the audio sources may change along the time frame n.

In one example embodiment, the stability of the audio sources (also referred to as audio source stability) may be used for setting if the source parameters, such as the spectral parameters introduced for assisting the determination of the spatial parameters, are modified or kept fixed during the determination process. This setting may be useful in informed usage scenarios with confident guidance metadata, for example, where certain prior knowledge of the audio sources such as positions of the audio source have been provided.

In one example embodiment, the type of audio source mixing may be used to set if the audio sources are mixed in an instantaneous way, or a convolutive way. This setting may determine if the spatial parameters $A_{f,n}$ may change along the frequency bin f.

Note that the source settings are not limited to the above mentioned examples, but can be extended to many other settings such as spatial guidance metadata, user guidance metadata, Time-Frequency guidance metadata, and so on.

Source Parameter Initialization

The source parameter initialization may be performed in the source parameter initialization unit 301 of the system 300 before processing of joint spatial parameter determination.

In some example embodiments, before the process of spatial parameter determination, the spatial parameters $A_{f,n}$ may be set with initialized values. For example, the spatial parameters $A_{f,n}$ may be initialized by random data, and then may be normalized by imposing $\Sigma_i|a_{ij,fn}|^2=1$.

In the process of spatial parameter determination, as described below, spectral parameters may be introduced as principle parameters in order to determine the spatial parameters. In some example embodiments, a spectral parameter of an audio source may be modeled by a non-negative matrix factorization (NMF) model. Accordingly, a spectral parameter of an audio source j may be initialized as non-negative matrices $\{W_j, H_j\}$, all elements in which matrices are non-negative random values. $W_j(\in\mathbb{R}_{\geq 0}^{F\times K})$ is a non-negative matrix that involves spectral components of the target audio source as column $\mathbb{R}$ vectors, and $H_j(\in\mathbb{R}_{\geq 0}^{K\times N})$ is a non-negative matrix with row vectors that correspond to temporal activation of each spectral component. Unless specifically indicated otherwise herein, K represents the number of NMF components.

In an example embodiment, the power of the noise signal $b_{fn}$ may be initialized to be in proportion to power of the input audio content, and it may diminish along with the iteration number of the joint determination in the joint determiner 303 in some examples. For example, the power of the noise signal may be determined as:

$$A_{b,f}=|b_{fm}|^2=(0.01\cdot\Sigma_i\Sigma_n|x_{i,fn}|^2)/(N\cdot 1) \tag{3}$$

In some example embodiments, as an intermediate parameter, the covariance matrix of the audio content $C_{xf}$ may also be determined in the source parameter initialization for subsequent processing. The covariance matrix may be calculated in the STFT domain. In one example embodiment, the covariance matrix may be calculated by averaging the input audio content over all the frames:

$$C_{X,f}=\frac{1}{N}\Sigma_n X_{f,n}X_{f,n}^H \tag{4}$$

Where the superscript H represents Hermitian conjugation permutation

Joint Determination of Spatial Parameter

As mentioned above, spatial parameters of the audio sources may be jointly determined based on the linear combination characteristic and the orthogonality characteristic of the audio sources. An additive source model may be used to model the audio content based on the linear combination characteristic. One typical additive source model may be a NMF Model. An independent/uncorrelated source model may be used to model the audio content based on the orthogonality characteristic. One typical independent/uncorrelated source model may be an adaptive de-correlation model. The joint determination of the spatial parameters may be performed in the joint determiner 303 of the system 300.

Before describing the joint determination of the spatial parameters, some example calculation in the NMF model and the adaptive de-correlation model will be first set forth below.

Source Parameter Calculation with NMF Model

In one example embodiment, the NMF model may be applied on the basis of the power spectrums of the audio sources to be separated. The power spectrum matrix of the audio sources to be separated may be represented as $\hat{\Sigma}_{s,fn}=\mathrm{diag}([\hat{C}_{S,fn}])=[\hat{\Sigma}_j]_j$, where $\hat{\Sigma}_j$ is a power spectrum of an audio source j, and $\hat{\Sigma}_{s,fn}$ represents aggregation of power spectrums of all J audio sources. The form of the spectral parameter $\{W_j, H_j\}$ may model an audio source j with a semantically meaningful (interpretable) representation. With the spectral parameters in form of nonnegative matrices $\{W_j, H_j\}$, the power spectrums $\hat{\Sigma}_{s,fn}$ may be estimated in the NMF model by using Itakura-Saito divergence.

In some example embodiments, for each audio source j, its power spectrum $\hat{\Sigma}_j$ may be estimated in a first iterative process as illustrated in Pseudo code 1 in FIG. 4.

In the beginning of the first iterative process, the NMF matrices $\{W_j, H_j\}$ may be initialized as mentioned above, and the power spectrums of the audio sources $\hat{\Sigma}_{s,fn}$ may be initiated as $\hat{\Sigma}_{s,fn}=\mathrm{diag}([\hat{C}_{s,fn}])=[\hat{\Sigma}_j]_j$, where $\hat{\Sigma}_j \approx W_j H_j$ and j=1, 2, . . . , J.

In each iteration of the first iterative process, the NMF matrix $W_j$ may be updated as:

$$W_j \leftarrow W_j \frac{(W_j H_j)^{-2} \hat{\Sigma}_j * H_j^H}{(W_j H_j)^{-1} * H_j^H} \tag{5}$$

In each iteration of the first iterative process, the NMF matrix $H_j$ may be updated as:

$$H_j \leftarrow H_j \frac{W_j^H * \hat{\Sigma}_j (W_j H_j)^{-2}}{W_j^H * (W_j H_j)^{-1}} \tag{6}$$

After the NMF matrices $\{W_j, H_j\}$ are obtained in each iteration, the power spectrums $\hat{\Sigma}_{s,fn}$ may be updated based on the obtained NMF matrices $\{W_j, H_j\}$ for use in next iteration. The iteration number of the first iterative process may be predetermined, and may be 1-20 times, or the like.

It should be noted that other known divergence methods for NMF estimation can also be applied and the scope of example embodiments disclosed herein is not limited in this regard.

Source Parameter Calculation with Adaptive De-correlation Model

As mentioned above, the power spectrums of audio sources are determined by $\hat{\Sigma}_{s,fn}=\mathrm{diag}([\hat{C}_{S,fn}])=[\hat{\Sigma}_j]_j$. Therefore, the covariance matrix of the audio sources $C_{S,fn}$ may be determined in order to determine the power spectrums in the adaptive de-correlation model. Based on the orthogonality characteristic of the audio sources in the audio content, the covariance matrix of the audio sources $C_{S,fn}$ is supposed to be diagonal. On the basis of the covariance matrix of the audio content represented in Equation (4) as well as the mixing model of the audio content represented in Equation (1), the covariance matrix of the audio content may be rewritten as:

$$C_{X,fn}=A_{f,n} C_{S,fn} A_{f,n}^H + \Lambda_{b,f} \tag{7}$$

In one example embodiment, the covariance matrix of the audio sources may be estimated based on a backward model as given below:

$$\hat{C}_{S,fn}=D_{f,n}(C_{X,fn}-\Lambda_{b,f})D_{f,n}^H \tag{8}$$

The inaccuracy of the estimation may be considered as an estimation error as below:

$$E_{f,n}=D_{f,n}(C_{X,fn}-\Lambda_{b,f})D_{f,n}^H - C_{S,fn} \tag{9}$$

The estimation of the inverse matrix $D_{f,n}$ of the spatial parameters $A_{f,n}$ may be estimated as below:

$$\hat{D}_{f,n} = \begin{cases} \hat{\sum_{s,fn}} A_{fn}^H \left( A_{fn} \hat{\sum_{s,fn}} A_{fn}^H + \sum_{b,f} \right)^{-1}, & (J \geq I) \quad (10) \\ \left( A_{fn}^H \overset{-1}{\sum_{b,f}} A_{fn} + \hat{\sum_{s,fn}}^{-1} \right)^{-1} A_{fn}^H \overset{-1}{\sum_{b,fn}}, & (J < I) \quad (11) \end{cases}$$

Note that in an underdetermined condition (J≥I), Equation (10) may be applied, and in an over-determined condition (J<I), Equation (11) may be applied for computation efficiency.

The inverse matrix $D_{f,n}$, as well as the covariance matrix of the audio sources $C_{S,fn}$ may be determined by decreasing the estimation error or by minimizing the estimation error as below:

$$\hat{C}_{S,fn}, \hat{D}_{f,n} = \mathrm{argmin}_{C_{S,fn}, D_{f,n}} \|E_{f,n}\|_F^2 \tag{12}$$

Equation (12) represents a least squares (LS) estimation problem to be solved. In one example embodiment, it may be solved in a second iterative process with a gradient descent algorithm as illustrated in Pseudo code 2 in FIG. 5.

In the gradient descent algorithm, the covariance matrix $C_{X,fn}$ and an estimation of power of the noise signal $\Lambda_{b,f}$ may be used as input. Before the beginning of the second iterative process, the estimation of the covariance matrix of the audio sources $\hat{C}_{S,fn}$ may be initialized by the power spectrums $[\hat{\Sigma}_j]_j$, which power spectrums may be estimated by the initialized NMF matrices $\{W_j, H_j\}$ or the NMF matrices $\{W_j, H_j\}$ obtained in the first iterative process described above. The inverse matrix $\hat{D}_{f,n}$ may also be initialized.

In order to decrease the estimation error of the covariance matrix of the audio sources based on Equation (12), in each iteration of the second iterative process, the inverse matrix $\hat{D}_{f,n}$. may be updated by the following Equations (13) and (14) in one example embodiment:

$$\nabla D_{f,n} = \frac{\mu \cdot \left[ \hat{D}_{f,n}(C_{X,fn} - \Lambda_{b,f}) \hat{D}_{f,n}^H - diag\left(\hat{D}_{f,n}(C_{X,fn} - \Lambda_{b,f}) \hat{D}_{f,n}^H\right) \right] \hat{D}_{f,n} C_{X,fn}}{\|\hat{D}_{f,n}\|_F^2 \cdot \|C_{X,fn} - \Lambda_{b,f}\|_F^2 + \varepsilon} \tag{13}$$

and then, $$\hat{D}_{f,n} \leftarrow \hat{D}_{f,n} + \nabla D_{f,n} \tag{14}$$

In Equation (13), μ represents a learn step for the gradient descent method, and ∈ represents a small value to avoid division by zero. $\|\bullet\|_F^2$ represents squared Frobenius Norm, which consists in the sum of the square of all the matrix entries, and for a vector, $|\bullet\|_F^2$ equals to the dot product of the vector with itself. $\|\bullet\|_F$ represents Frobenius Norm which equals to the square root of the squared Frobenius Norm. Note that as given in Equation (13), it is desirable to normalize the gradient terms by the powers (squared Frobenius Norm), so as to scale the gradient to give comparable update steps for different frequencies.

With the updated inverse matrix $\hat{D}_{f,n}$ in each iteration, the covariance matrix of the audio sources $\hat{C}_{S,fn}$ may be updated as below according to Equation (8):

$$\overline{C}_{S,fn} \leftarrow \hat{D}_{f,n} C_{X,fn} \hat{D}_{f,n}^{H} \tag{15}$$

The power spectrums may be updated based on the updated covariance matrix $\hat{C}_{S,fn}$, which may be represented as below:

$$[\hat{\Sigma}_j]_j \leftarrow \mathrm{diag}(\hat{D}_{f,n} C_{X,fn} \hat{D}_{f,n}^{H}) \tag{16}$$

In another embodiment, Equation (13) may be simplified by ignoring the additive noise as below:

$$\nabla D_{f,n} = \frac{\mu \cdot [\hat{D}_{f,n} C_{X,fn} \hat{D}_{f,n}^{H} - diag(\hat{D}_{f,n} C_{X,fn} \hat{D}_{f,n}^{H})] \hat{D}_{f,n} C_{X,fn}}{\|\hat{D}_{f,n}\|_F^2 \cdot \|C_{X,fn}\|_F^2 + \varepsilon} \tag{17}$$

It can be appreciated that with or without the noise signal ignored, the covariance matrix of the audio sources and the power spectrums can be updated by Equations (15) and (16) respectively. However, in some other cases, the noise signal may be taken into account when updating the covariance matrix of the audio sources and the power spectrums.

In some example embodiments, the iteration number of the second iterative process may be predetermined, for example, as 1-20 times. In some other embodiments, the iteration number of the second iterative process may be controlled by a degree of orthogonality control, which will be described below.

It should be appreciated that the adaptive de-correlation model by itself may seem to have an arbitrary permutation for each frequency. Example embodiments disclosed herein address this permutation issue as described below with respect to the joint determination process.

With the source settings and the initialized source parameters, spatial parameters of audio sources may be jointly determined, for example, in an EM iterative process. Some implementations of the joint determination in the EM iterative process will be described below.

First Example Implementation

In a first example implementation, in order to determine a spatial parameter of an audio source, a power spectrum of the audio source may be determined based on the linear combination characteristic first and may then be updated based on the orthogonality characteristic. The spatial parameter of the audio source may be determined based on the updated power spectrum.

In the example embodiments of the system 300, the first intermediate parameter determination unit 3031 of the joint determiner 303 may be configured to determine the power spectrum parameters of the audio sources contained in the input audio content based on the additive source model, such as the NMF model. The second intermediate parameter determination unit 3032 of the joint determiner 303 may be configured to refine the power spectrum parameters based on the independent/uncorrelated source model, such as the adaptive de-correlation model. Then the spatial parameter determination unit 3033 may be configured to determine the spatial parameters of the audio sources based on the updated power spectrum parameters.

In some example embodiments, the joint determination of the spatial parameters may be processed in an Expectation-Maximization (EM) iterative process. Each EM iteration of the EM iterative process may include an expectation step and a maximization step. In the expectation step, conditional expectations of intermediate parameters for determining the spatial parameters may be calculated. While in the maximization step, the principle parameters for describing and/or recovering the audio sources (including the spatial parameters and the spectral parameters of the audio sources), may be updated. The expectation step and the maximization step may be iterated to determine spatial parameters for audio source separation by a limited number of times, such that perceptually natural audio sources can be obtained while enabling a stable and rapid convergence of the EM iterative process.

In the first example implementation, for each EM iteration of the EM iterative process, the power spectrum parameters of the audio sources may be determined by using the spectral parameters of the audio sources determined in a previous EM iteration (e.g., the last time of EM iteration) based on the linear combination characteristic, and the power spectrum parameters may be updated based on the orthogonality characteristic. In each EM iteration, the spatial parameters and the spectral parameters of the audio sources may be updated based on the updated power spectrum parameters.

Figure 6:
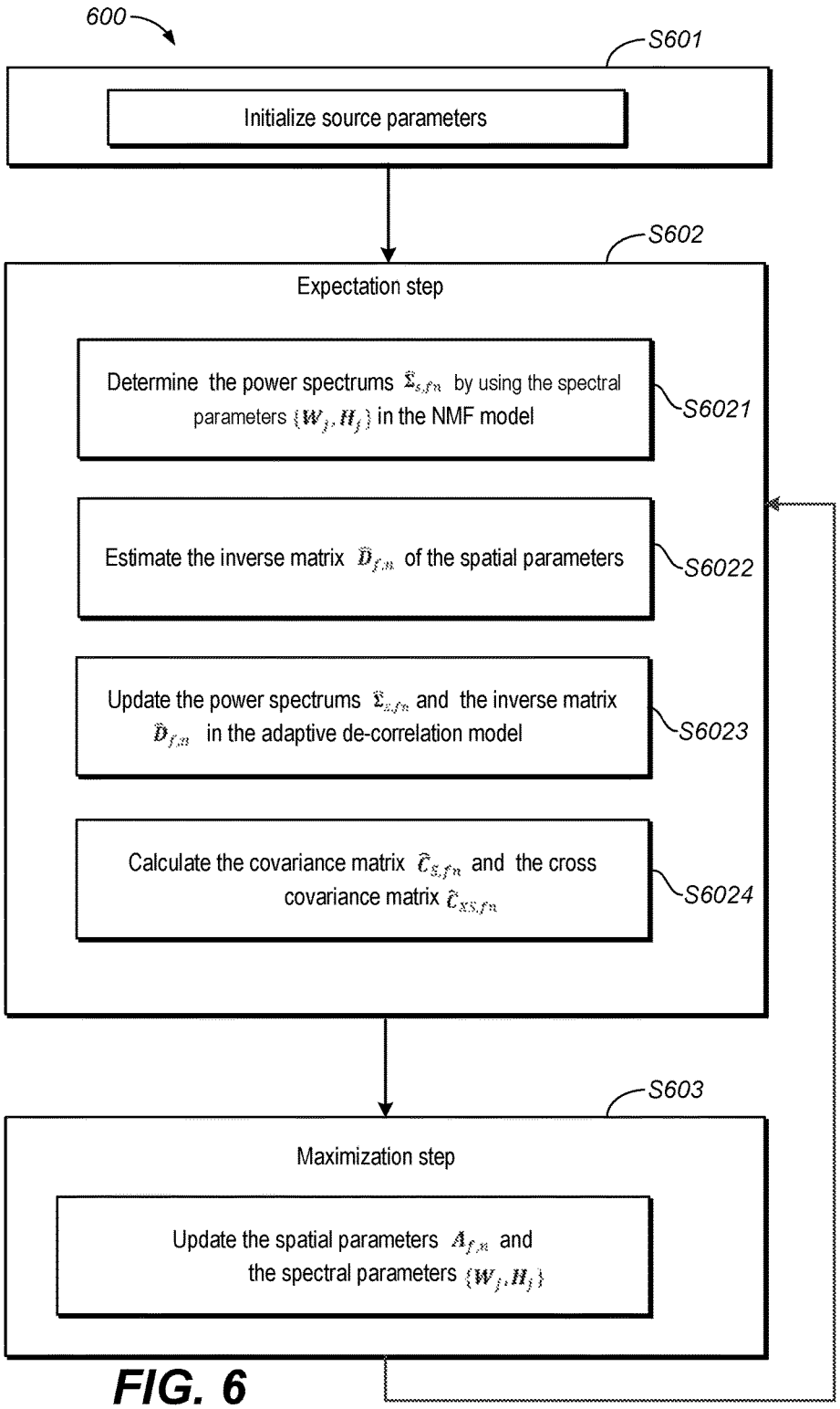
FIG. 6 illustrates a flowchart of a process for spatial parameter determination in accordance with one example embodiment disclosed herein.

An example process will be described based on the above description of the NMF model and the adaptive de-correlation model. Reference is made to FIG. 6, which depicts a flowchart of a process for spatial parameter determination 600 in accordance with an example embodiment disclosed herein.

At S601, source parameters used for the determination may be initialized. The source parameter initialization is described above. In some example embodiments, the source parameter initialization may be performed by the source parameter initialization unit 301 in the system 300.

For an expectation step S602, the power spectrums $\hat{\Sigma}_{s,fn}$ of the audio sources may be determined in the NMF model at S6021 by using the spectral parameter $\{W_j, H_j\}$ of each audio source j. The determination of the power spectrums $\hat{\Sigma}_{s,fn}$ in the NMF model may be referred to the description above with respect to the NMF model and Pseudo code 1 in FIG. 4. For example, the power spectrums $\hat{\Sigma}_{s,fn} = \mathrm{diag}([w_{j,fk} h_{j,kn}])$. In the first EM iteration, the spectral parameters $\{W_j, H_j\}$ of each audio source j may be the initialized spectral parameters from S601. In subsequent EM iterations, the updated spectral parameters from a previous EM iteration, for example, from the maximization step of the previous EM iteration may be used.

At a sub step S6022, the inverse matrix $\hat{D}_{f,n}$ of the spatial parameters may be estimated according to Equation (10) or (11) by using the power spectrums $\hat{\Sigma}_{s,fn}$ obtained at S6021 and the spatial parameters $A_{fn}$. In the first EM iteration, the spatial parameters $A_{fn}$ may be the initialized spatial parameters from S601. In subsequent EM iterations, the updated spatial parameters from a previous EM iteration, for example, from the maximization step of the previous EM iteration may be used.

At a sub step S6023 in the expectation step S602, the power spectrums $\hat{\Sigma}_{s,fn}$ and the inverse matrix $\hat{D}_{f,n}$ of the spatial parameters may be updated in the adaptive de-correlation model. The updating may be referred to the description above with respect to the adaptive de-correlation model and Pseudo code 2 shown in FIG. 5. In the step S6023, the inverse matrix $\hat{D}_{f,n}$ may be initialized by the inverse matrix from the step S6022, and the covariance matrix $\hat{C}_{S,fn}$ of the audio sources may also be initialized according to the power spectrums from the step S6021.

In the expectation step S602, the conditional expectations of the covariance matrix $\hat{C}_{S,fn}$ and the cross covariance matrix $\hat{C}_{XS,fn}$ may also be calculated in a sub step S6024, in order to update the spatial parameters. The covariance matrix $\hat{C}_{S,fn}$ may be calculated in the adaptive de-correlation model, for example, by Equation (15). The cross covariance matrix $\hat{C}_{XS,fn}$ may be calculated as below:

$$\hat{C}_{XS,fn}=X_{f,n}\hat{s}_{f,n}^{H}\approx C_{X,fn}\hat{D}_{f,n}^{H} \tag{18}$$

For a maximization step S603, the spatial parameters $A_{fn}$ and the spectral parameters $\{W_j, H_j\}$ may be updated. In some example embodiments, the spatial parameters $A_{fn}$ may be updated based on the covariance matrix $\hat{C}_{S,fn}$ and the cross covariance matrix $\hat{C}_{XS,fn}$ from the expectation step S602 as below:

$$A_{fn}=\hat{C}_{XS,fn}\hat{C}_{S,fn}^{-1} \tag{19}$$

In some example embodiments, the spectral parameters $\{W_j, H_j\}$ may be updated by using the power spectrums $\hat{\Sigma}_{s,fn}$ from expectation step S602 based on the first iterative process shown in FIG. 4. For example, the spectral parameter $W_j$ may be updated by Equation (5), while the spectral parameter $H_j$ may be updated by Equation (6).

After S603, the EM iterative process may then return to S602, and the updated spatial parameters $A_{fn}$ and spectral parameters $\{W_j, H_j\}$ may be used as inputs of S602.

In some example embodiments, before beginning of a next EM iteration, the spatial parameters $A_{fn}$ and the spectral parameters $\{W_j, H_j\}$ may be normalized by imposing $\Sigma_i|a_{ij,fn}|^2=1$ and $\Sigma_f w_{j,fk}=1$, and then scaling $h_{j,kn}$ accordingly. The normalization may eliminate trivial scale indeterminacies.

The number of the EM iterative process may be predetermined, such that audio sources with perceptually natural sounding as well as a proper mutual orthogonality degree may be obtained based on the final spatial parameters.

Figure 7:
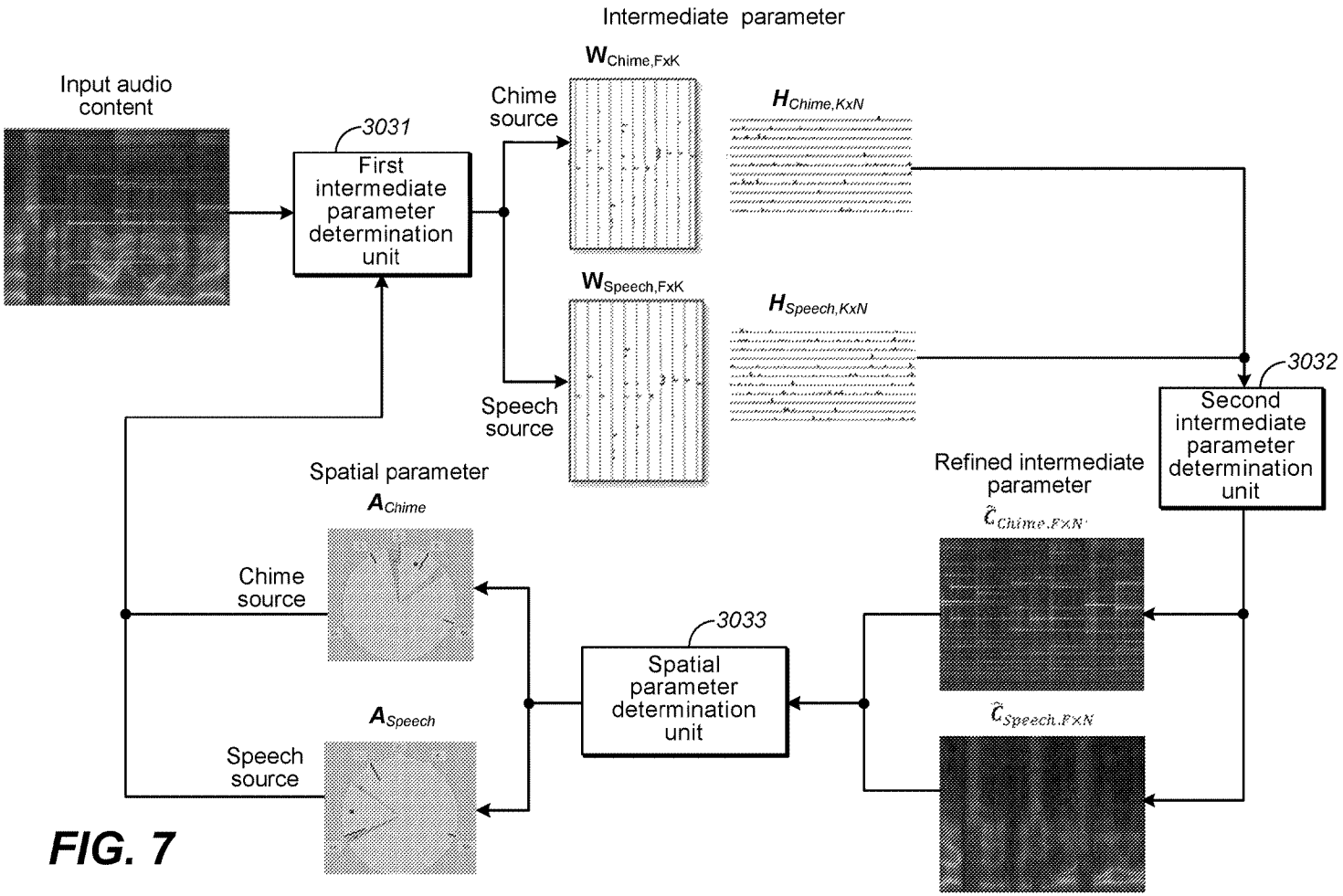
FIG. 7 illustrates a schematic diagram of a signal flow in joint determination of the source parameters in accordance with one example embodiment disclosed herein.

FIG. 7 depicts a schematic diagram of a signal flow in joint determination of the source parameters in accordance with the first example implementation disclosed herein. For simplicity, only a mono mixture signal with two audio sources (a chime source and a speech source) is illustrated as input audio content.

The input audio content is first processed in an additive model (for example, the NMF model) by the first intermediate parameter determination unit 3031 of the system 300 to determine the power spectrums of the chime source and the speech source. The spectral parameters $\{W_{Chime\ F\times K}, H_{Chime,\ K\times N}\}$ and $\{W_{Speech,\ F\times K}, H_{Speech,\ F\times K}\}$ as depicted in FIG. 7 may represent the determined power spectrums $\hat{\Sigma}_{s,fn}$, since for each audio source j, its power spectrum $\hat{\Sigma}_i\approx W_jH_i$ in the NMF model. The power spectrums are updated with an; independent/uncorrelated model (for example, the adaptive de-correlation model) by the second intermediate parameter determination unit 3032 of the system 300. The covariance matrices $\hat{C}_{Chime,F\times N}$ and $\hat{C}_{Speech,\ F\times N}$ as depicted in FIG. 7 may represent the updated power spectrums since in the adaptive de-correlation model, $\hat{\Sigma}_{s,fn}\mathrm{diag}([\hat{C}_{S,fn}])$. The updated power spectrums may then be provided to the spatial parameter determination unit 3033 to obtain the spatial parameters of the chime source and the speech source, $A_{Chime}$ and $A_{Speech}$. The spatial parameters may be fed back to the first intermediate parameter determination unit 3031 for the next iteration of processing. The iteration process may continue until certain convergence is achieved.

Second Example Implementation

In a second example implementation, in order to determine a spatial parameter of an audio source, a power spectrum of the audio source may be determined based on the orthogonality characteristic first and may then be updated based on the linear combination characteristic. The spatial parameter of the audio source may be determined based on the updated power spectrum.

In the example embodiments of the system 300, the first intermediate parameter determination unit 3031 of the joint determiner 303 may be configured to determine the power spectrum parameters based on the independent/uncorrelated source model, such as the adaptive de-correlation model. The second source parameter determination unit 3032 of the joint determiner 303 may be configured to refine the power spectrum parameters based on the additive source model, such as the NMF model. Then the spatial parameter determination unit 3033 may be configured to determine the spatial parameters of the audio sources based on the updated power spectrum parameters.

In some example embodiments, the joint determination of the spatial parameters may be processed in an EM iterative process. In each EM iteration of the EM iterative process, for an expectation step, the power spectrum parameters of the audio sources may be determined by using the spatial parameters and the spectral parameters determined in a previous EM iteration (e.g., the last time of EM iteration) based on the orthogonality characteristic, the power spectrum parameters of the audio sources may be updated based on the linear combination characteristic, and the spatial parameters and the spectral parameters of the audio source may be updated based on the updated power spectrum parameters.

Figure 8:
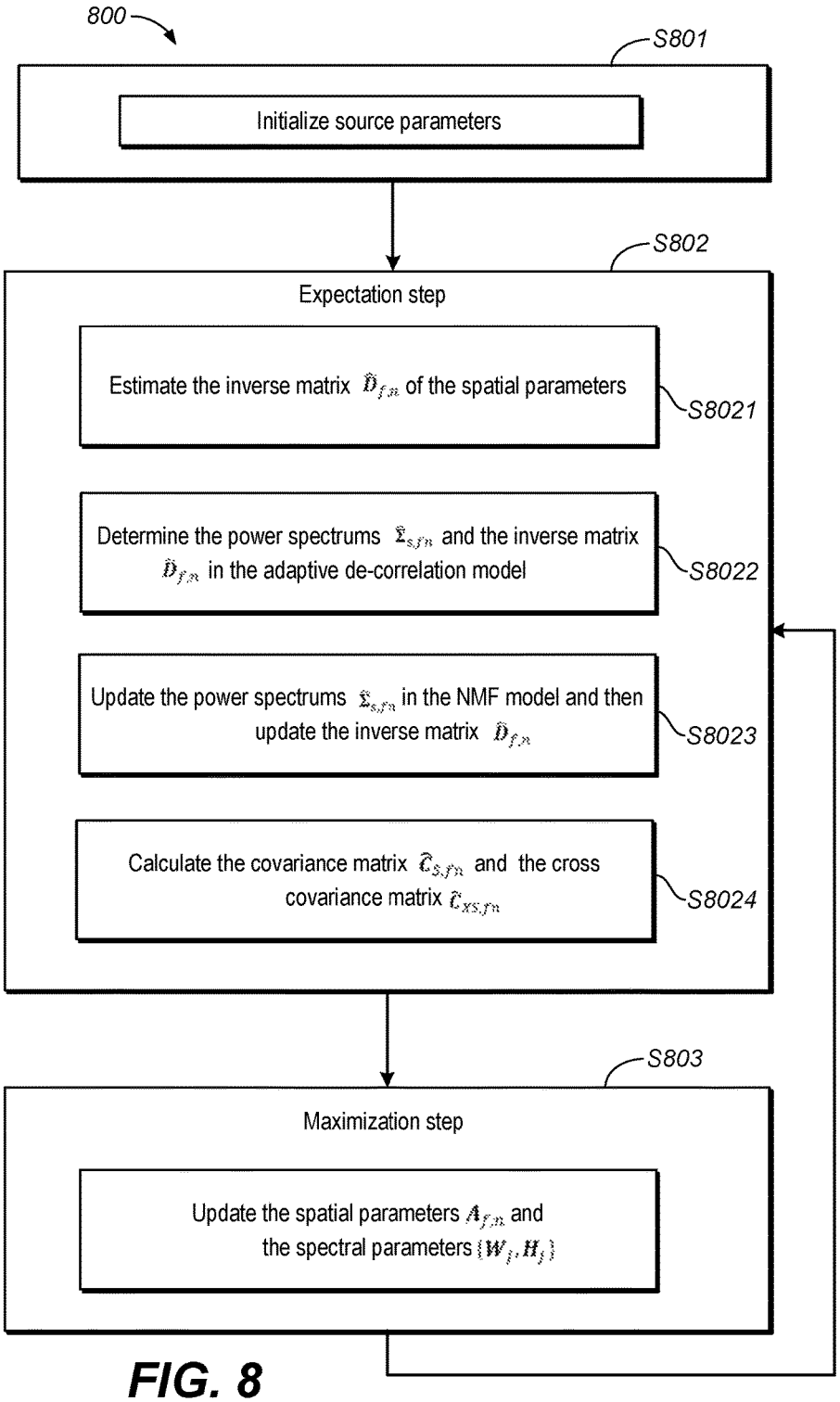
FIG. 8 illustrates a flowchart of a process for spatial parameter determination in accordance with another example embodiment disclosed herein.

An example process will be described based on the above description of the NMF model and the adaptive de-correlation model. Reference is made to FIG. 8, which depicts a flowchart of a process for spatial parameter determination 800 in accordance with another embodiment disclosed herein.

At S801, source parameters used for the determination may be initialized. The source parameter initialization is described above. In some example embodiments, the source parameter initialization may be performed by the source parameter initialization unit 301 in the system 300.

For an expectation step S802, the inverse matrix $\hat{D}_{f,n}$ of the spatial parameters may be estimated at S8021 according to Equation (10) or (11) by using the spectral parameters $\{W_j, H_j\}$ and the spatial parameters $A_{fn}$. The spectral parameters $\{W_j, H_j\}$ may be used to calculate the power spectrums $\hat{\Sigma}_{s,fn}$ of the audio sources for use in Equation (10) or (11). In the first EM iteration of the EM iterative process, the initialized spectral parameters and spatial parameters from S801 may be used. In subsequent EM iterations, the updated spatial parameters and the spectral parameters from a previous EM iteration, for example, from a maximization step of the previous EM iteration may be used.

At a sub step S8022, the power spectrums $\hat{\Sigma}_{s,fn}$ and the inverse matrix $\hat{D}_{f,n}$ of the spatial parameters may be determined in the adaptive de-correlation model. The determination may be referred to the description above with respect to the adaptive de-correlation model and Pseudo code 2 shown in FIG. 5. In the expectation step S802, the inverse matrix $\hat{D}_{f,n}$ may be initialized by the inverse matrix from the sub step S8021. In the first EM iteration, the covariance matrix of the audio sources $\hat{C}_{S,fn}$ may be initialized by using the initialized values of the spectral parameters $\{W_j, H_j\}$ from S801. In the subsequent EM iterations, the updated spectral parameters $\{W_j, H_j\}$ from a previous EM iteration, for example, from a maximization step of the previous EM iteration may be used.

At a sub step S8023, the power spectrums $\hat{\Sigma}_{s,fn}$ may be updated in the NMF model and then the inverse matrix $D_{f,n}$ is updated. The updating of the power spectrums $\hat{\Sigma}_{s,fn}$ may be referred to the description above with respect to the NMF model and Pseudo code 1 in FIG. 4. For example, the power spectrums $\hat{\Sigma}_{s,fn}$ from the step S8022 may be updated in this step using the spectral parameters $\{W_j, H_j\}$. The initialization of the spectral parameters $\{W_j, H_j\}$ in Pseudo code 1 may be the initialized values from S801, or may be the updated values from a previous EM iteration, for example, from a maximization step of the previous iteration. The inverse matrix $D_{f,n}$ may be updated based on the updated power spectrums in the NMF model by using Equation (10) or (11).

In the expectation step S802, the conditional expectations of the covariance matrix $\hat{C}_{S,fn}$ and the cross covariance matrix $\hat{C}_{XS,fn}$ may also be calculated in a sub step S8024, in order to update the spatial parameters. The calculation of the covariance matrix $\hat{C}_{S,fn}$ and the cross covariance matrix $\hat{C}_{XS,fn}$ may be similar to what is described in the first example implementation, which is omitted here for sake of clarity.

For a maximization step S803, the spatial parameters $A_{fn}$ and the spectral parameters $\{W_j, H_j\}$ may be updated. The spatial parameters may be updated according to Equation (19) based on the calculated covariance matrix $\hat{C}_{S,fn}$ and the cross covariance matrix $\hat{C}_{XS,fn}$ from the expectation step S802. In some example embodiments, the spectral parameters $\{W_j, H_j\}$ may be updated by using the power spectrums $\hat{\Sigma}_{s,fn}$ from expectation step S802 based on the first iterative process shown in FIG. 4. For example, the spectral parameter $W_i$ may be updated by Equation (5), while the spectral parameter $H_j$ may be updated by Equation (6).

After S803, the EM iterative process may then return to S802, and the updated spatial parameters $A_{fn}$ and the spectral parameters $\{W_j, H_j\}$ obtained in S803 may be used as inputs of S802.

In some example embodiments, before beginning of a next EM iteration, the spatial parameters $A_{fn}$ and the spectral parameters $\{W_j, H_j\}$ may be normalized by imposing $\Sigma_i|a_{ij,fn}|^2=1$ and $\Sigma_f w_{j,fk}=1$, and then scaling $h_{j,kn}$ accordingly. The normalization may eliminate trivial scale indeterminacies.

The number of the EM iterative process may be predetermined, such that audio sources with perceptually natural sounding as well as a proper mutual orthogonality degree may be obtained based on the final spatial parameters.

Figure 9:
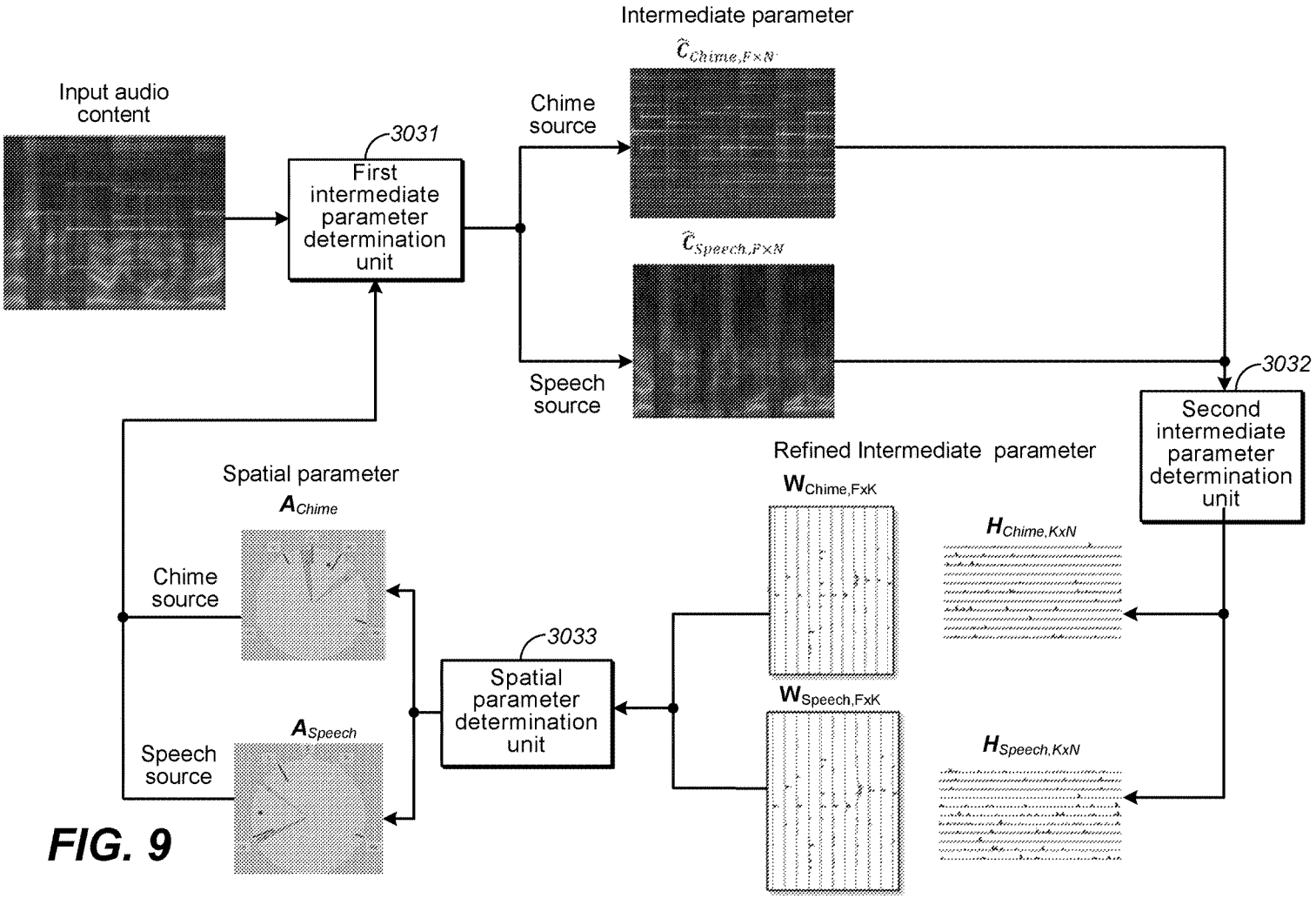
FIG. 9 illustrates a schematic diagram of a signal flow in joint determination of the source parameters in accordance with another example embodiment disclosed herein.

FIG. 9 depicts a schematic diagram of a signal flow in joint determination of the source parameters in accordance with the second example implementation disclosed herein. For simplicity, only a mono mixture signal with two audio sources (a chime source and a speech source) is illustrated as input audio content.

The input audio content is first processed in an independent/uncorrelated model (for example, the adaptive de-correlation model) by the first intermediate parameter determination unit 3031 of the system 300 to determine the power spectrums of the chime source and the speech source. The covariance matrices $\hat{C}_{Chime,F\times N}$ and $\hat{C}_{Speech,F\times N}$ as depicted in FIG. 9 may represent the determined power spectrums $\hat{\Sigma}_{s,fn}$, since in the adaptive de-correlation model, $\hat{\Sigma}_{s,fn}=\text{diag}([\hat{C}_{S,fn}])$. The power spectrums are updated in an additive model (for example, the NMF model) by the second intermediate parameter determination unit 3032 of the system 300. The spectral parameters $\{W_{Chime,F\times K}, H_{Chime,K\times N}\}$ and $\{W_{Speech,F\times K}, H_{Speech,F\times K}\}$ as depicted in FIG. 9 may represent the updated power spectrums since for each audio source j, its power spectrum $\hat{\Sigma}_j \approx W_j H_j$ in the NMF model. The updated power spectrums may then be provided to the spatial parameter determination unit 3033 to obtain the spatial parameters of the chime source and the speech source, $A_{Chime}$ and $A_{Speech}$. The spatial parameters may be fed back to the first intermediate parameter determination unit 3031 for the next iteration of processing. The iteration process may continue until certain convergence is achieved.

Third Example Implementation

In a third example implementation, in order to determine a spatial parameter of an audio source, the orthogonality characteristic is utilized first and then the linear combination characteristic is utilized. But unlike some embodiments of the second example implementation, the determination of the power spectrum based on the orthogonality characteristic is outside of the EM iterative process. That is, the power spectrum parameters of the audio sources may be determined based on the orthogonality characteristic by using the initialized values for the spatial parameters and the spectral parameters before the beginning of the EM iterative process. The determined power spectrum parameters may then be updated in the EM iterative process. In each EM iteration of the EM iterative process, the power spectrum parameters of the audio sources may be determined based on the linear combination characteristic by using the spectral parameters determined in a previous EM iteration (e.g., the last time of EM iteration), and then the spatial parameters and the spectral parameters of the audio sources may be determined based on the updated power spectrum parameters.

The NMF model may be used in the EM iterative process to update the spatial parameters in the third example implementation. Since the NMF model is sensitive to the initialized values, with a more reasonable values determined by the adaptive de-correlation model, results of the NMF model may be better for audio source separation.

Figure 10:
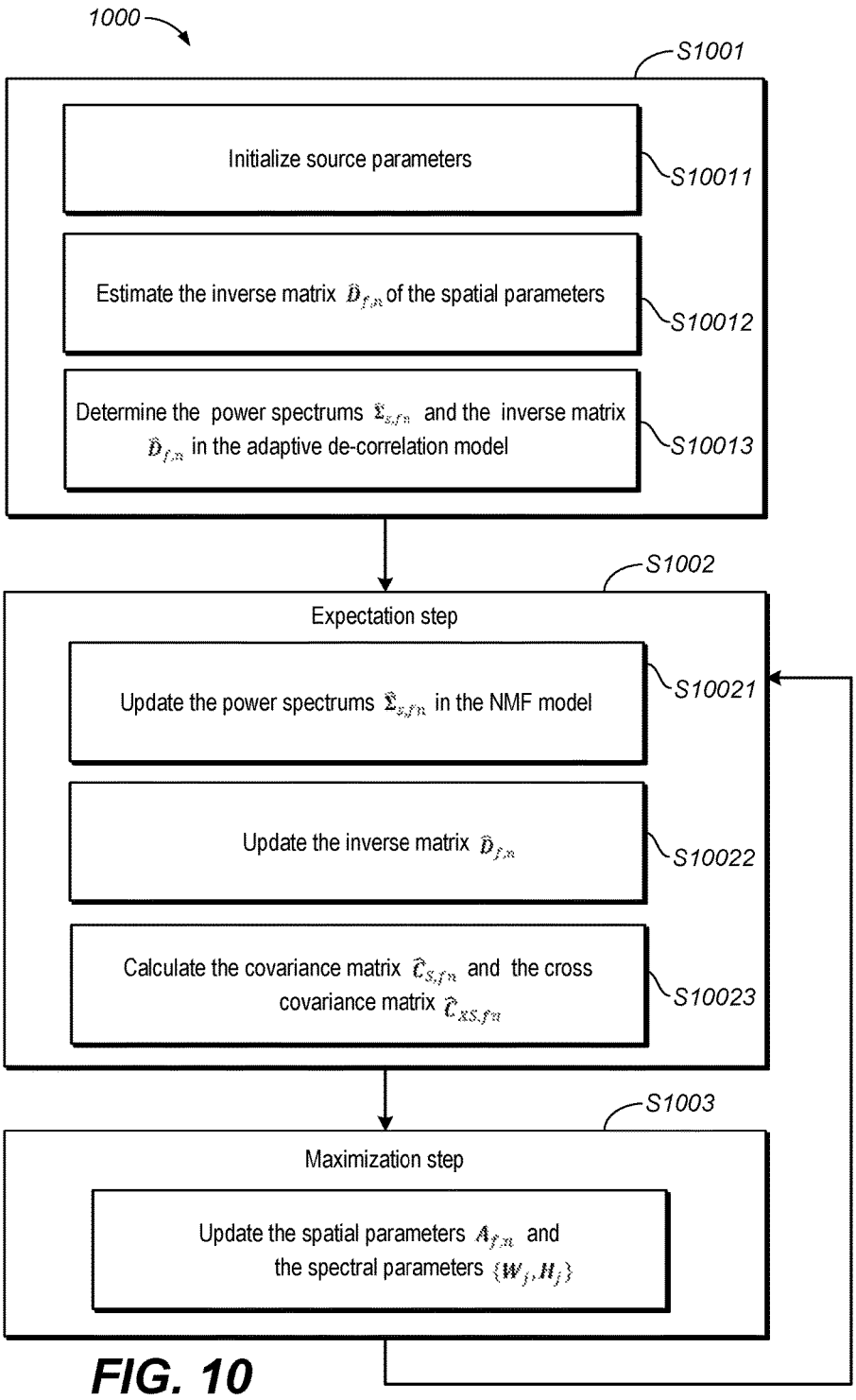
FIG. 10 illustrates a flowchart of a process for spatial parameter determination in accordance with yet another example embodiment disclosed herein.

An example process will be described based on the above description of the NMF model and the adaptive de-correlation model. Reference is made to FIG. 10, which depicts a flowchart of a process for spatial parameter determination 1000 in accordance with yet another example embodiment disclosed herein.

At step S1001, source parameters used for the determination may be initialized at a sub step S10011. The source parameter initialization is described above. In some example embodiments, the source parameter initialization may be performed by the source parameter initialization unit 301 in the system 300.

At a sub step S10012, the inverse matrix $\hat{D}_{fn}$ may be estimated according to Equation (10) or (11) by using the initialized spectral parameters $\{W_i, H_i\}$ and the initialized spatial parameters $A_{fn}$. The spectral parameters $\{W_i, H_i\}$ may be used to calculate the power spectrums $\hat{\Sigma}_{s,fn}$ of the audio sources for use in Equation (10) or (11).

At a sub step S10013, the power spectrums $\hat{\Sigma}_{s,fn}$ and the inverse matrix $\hat{D}_{f,n}$ of the spatial parameters may be determined in the adaptive de-correlation model. The determination may be referred to the description above with respect to the adaptive de-correlation model and Pseudo code 2 shown in FIG. 5. In Pseudo code 2, the inverse matrix $\hat{D}_{f,n}$ may be initialized by the determined inverse matrix at S10012. In Pseudo code 2, the covariance matrix of the audio sources $\hat{C}_{S,fn}$ may be initialized by the initialized values of the spectral parameters $\{W_j, H_j\}$ from S10011.

For an expectation step S1002, the power spectrums $\hat{\Sigma}_{s,fn}$ from S1001 may be updated in the NMF model at a sub step S10021. The updating of the power spectrums may be referred to the description above with respect to the NMF model and Pseudo code 1 in FIG. 4. The initialization of the spectral parameters $\{W_j, H_j\}$ in Pseudo code 1 may be the initialized values from S10011, or may be the updated values from a previous EM iteration, for example, from a maximization step of the previous iteration.

At a sub step S10022, the inverse matrix D f,n may be updated according to Equation (10) or (11) by using the power spectrums $\hat{\Sigma}_{s,fn}$ obtained at S10021 and the spatial parameters $A_{fn}$. In the first iteration, the initialized values for the spatial parameters may be used. In subsequent iterations, the updated values for the spatial parameters from a previous EM iteration, for example, from a maximization step of the previous iteration may be used.

In the expectation step S1002, the conditional expectations of the covariance matrix $\hat{C}_{S,fn}$ and the cross covariance matrix $\hat{C}_{XS,fn}$ may also be calculated in a sub step S10023, in order to update the spatial parameters. The calculation of the covariance matrix $\hat{C}_{S,fn}$ and the cross covariance matrix $\hat{C}_{XS,fn}$ may be similar to what is described in the first example implementation, which is omitted here for sake of clarity.

For a maximization step S1003, the spatial parameters $A_{fn}$ and the spectral parameters $\{W_j, H_j\}$ may be updated. The spatial parameters may be updated according to Equation (19) based on the calculated covariance matrix $\hat{C}_{S,fn}$ and the cross covariance matrix $\hat{C}_{XS,fn}$ from the expectation step S1002. In some example embodiments, the spectral parameters $\{W_j, H_j\}$ may be updated by using the power spectrums $\hat{\Sigma}_{s,fn}$ from expectation step S802 based on the first iterative process shown in FIG. 4. For example, the spectral parameter $W_j$ may be updated by Equation (5), while the spectral parameter $H_j$ may be updated by Equation (6).

After S1003, the EM iterative process may then return to S1002, and the updated spatial parameters $A_{fn}$ and spectral parameters $\{W_j, H_j\}$ obtained in S1003 may be used as inputs of S1002.

In some example embodiments, before beginning of a next EM iteration, the spatial parameters $A_{fn}$ and spectral parameters $\{W_j, H_j\}$ may be normalized by imposing $\Sigma_i|a_{ij,fn}|^2=1$ and $\Sigma_f w_{j,fk}=1$, and then scaling $h_{j,kn}$ accordingly. The normalization may eliminate trivial scale indeterminacies.

The number of the EM iterative process may be predetermined, such that audio sources with perceptually natural sounding as well as a proper mutual orthogonality degree may be obtained based on the final spatial parameters.

Figure 11:
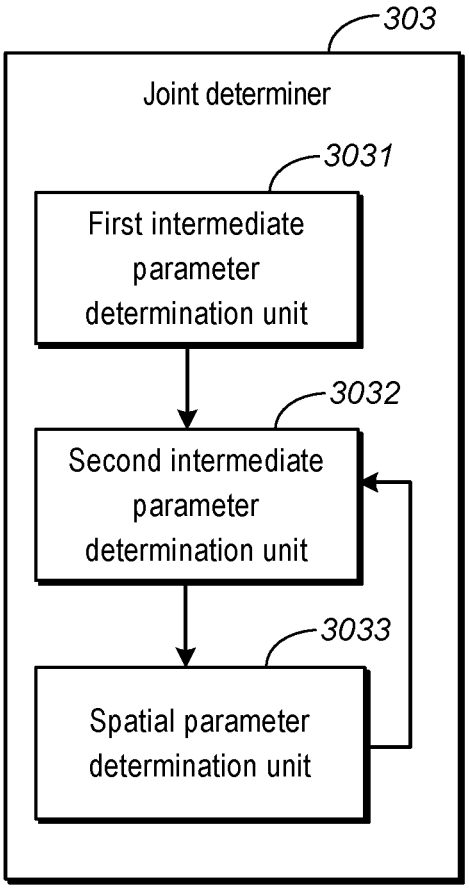
FIG. 11 illustrates a block diagram of a joint determiner for used in the system of FIG. 3 according to an example embodiment disclosed herein.

FIG. 11 depicts a block diagram of a joint determiner 303 for use in the system 300 according to an example embodiment disclosed herein. The joint determiner 303 depicted in FIG. 11 may be configured to perform the process in FIG. 10. As depicted in FIG. 11, the first intermediate parameter determination unit 3031 may be configured to determine the intermediate parameters outside of the EM iterative process. Particularly, the first intermediate parameter determination unit 3031 may be used to perform the steps S10012 and S10013 as described above. In order to update the intermediate parameters in an additive model, for example, a NMF model, the second intermediate parameter determination unit 3032 may be configured to perform the expectation step S1002 and the spatial parameter determination unit 3033 may be configured to perform the maximization step S1003. The outputs of the determination unit 3033 may be provided to the determination unit 3032 as inputs.

Figure 12:
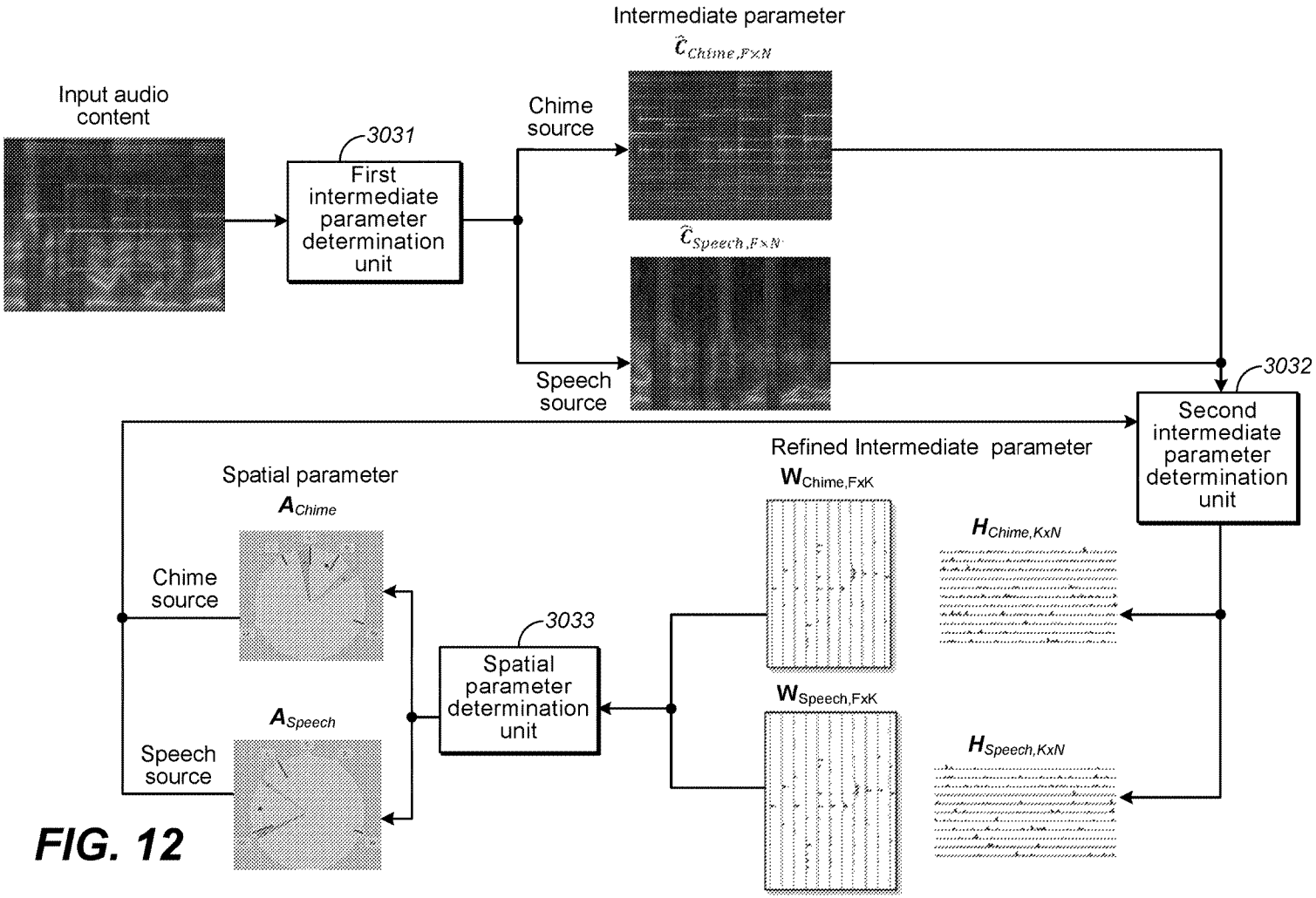
FIG. 12 illustrates a schematic diagram of a signal flow in joint determination of the source parameters in accordance with yet another example embodiment disclosed herein.

FIG. 12 depicts a schematic diagram of a signal flow in joint determination of the source parameters in accordance with the third example implementation disclosed herein. For simplicity, only a mono mixture signal with two audio sources (a chime source and a speech source) is illustrated as input audio content.

The input audio content is first processed in an independent/uncorrelated model (for example, the adaptive de-correlation model) by the first intermediate parameter determination unit 3031 of the system 300 to determine the power spectrums of the chime source and the speech source. The covariance matrices $\hat{C}_{Chime,F\times N}$ and $\hat{C}_{Speech,F\times N\ as}$ depicted in FIG. 12 may represent the determined power spectrums $\hat{\Sigma}_{s,fn}$, since in the adaptive de-correlation model, $\hat{\Sigma}_{s,fn}$=diag ([$\hat{C}_{S,fn}$]). The power spectrums are updated in an additive model (for example, a NMF model) by the second intermediate parameter determination unit 3032 of the system 300. The spectral parameters $\{W_{Chime,F\times K}, H_{Chime,K\times N}\}$ and $\{W_{Speech,F\times K}, H_{Speech,F\times K}\}$ as depicted in FIG. 12 may represent the updated power spectrum since for each audio source j, its power spectrum $\hat{\Sigma}_j \approx W_j H_j$ in the NMF model. The updated power spectrums may then be provided to the spatial parameter determination unit 3033 to obtain the spatial parameters of the chime source and the speech source, $A_{Chime}$ and $A_{Speech}$. The spatial parameters may be fed back to the second intermediate parameter determination unit 3032 for the next iteration of processing. The iteration process of the determination units 3032 and 3033 may continue until certain convergence is achieved.

Control of Orthogonality Degree

As mentioned above, orthogonality of the audio sources to be separated may be controlled to a proper degree, such that pleasant sounding sources can be obtained. The control of orthogonality degree may be combined in one or more of the first, second, or third implementation described above, and may be performed for example, by the orthogonality degree setting unit 302 in FIG. 3.

NMF models without proper orthogonality constraints are sometimes shown to be insufficient since simultaneous formation of similar spectral patterns for different audio sources is possible. Thus, there is no guarantee that one audio source becomes independent/uncorrelated from another after the audio source separation. This may lead to poor convergence performance and even divergence in some conditions. Particularly, when "audio source mobility" is set to estimate fast-moving audio sources, the spatial parameters may be time-varying, and thus the spatial parameters $A_{fn}$ may need to be estimated frame by frame. As given in Equation (19), $A_{fn}$ is estimated by calculating $\hat{C}_{XS,fn}\hat{C}_{S,fn}^{-1}$, which includes an inversion of a covariance matrix of $\hat{C}_{S,fn}$ of the audio sources. High correlation among sources may result in an ill-conditioned inversion so that it will lead to instabilities for estimating time-varying spatial parameters. These problems can be effectively solved by introducing the orthogonality constraints with the joint determination of the independent/uncorrelated source model.

On the other hand, independent/uncorrelated source models with assumption that the audio sources/components are statistically de-correlated (e.g., the adaptive de-correlation method and PCA) or independent (e.g., ICA) may produce crisp changes in the spectrum which may decrease the perceptual quality. One drawback of these models is perceivable artifacts such as musical noise, originating from unnatural, isolated time-frequency (TF) bins scattered over the time-frequency plane. In contrast, audio sources generated with NMF models are generally more pleasant to listen to and appear to be less prone to such artifacts.

Therefore, there is a tradeoff between the additive source model and the independent/uncorrelated model used in the joint determination, so as to obtain pleasant sounding sources despite of certain acceptable amount of correlation between the sources.

In some example embodiments, the iterative process performed in the adaptive de-correlation model, for example, the iterative process shown in Pseudo code 2, may be controlled so as to restrain the orthogonality among the audio sources to be separated. The orthogonality degree may be controlled by analyzing the input audio content.

Figure 13:
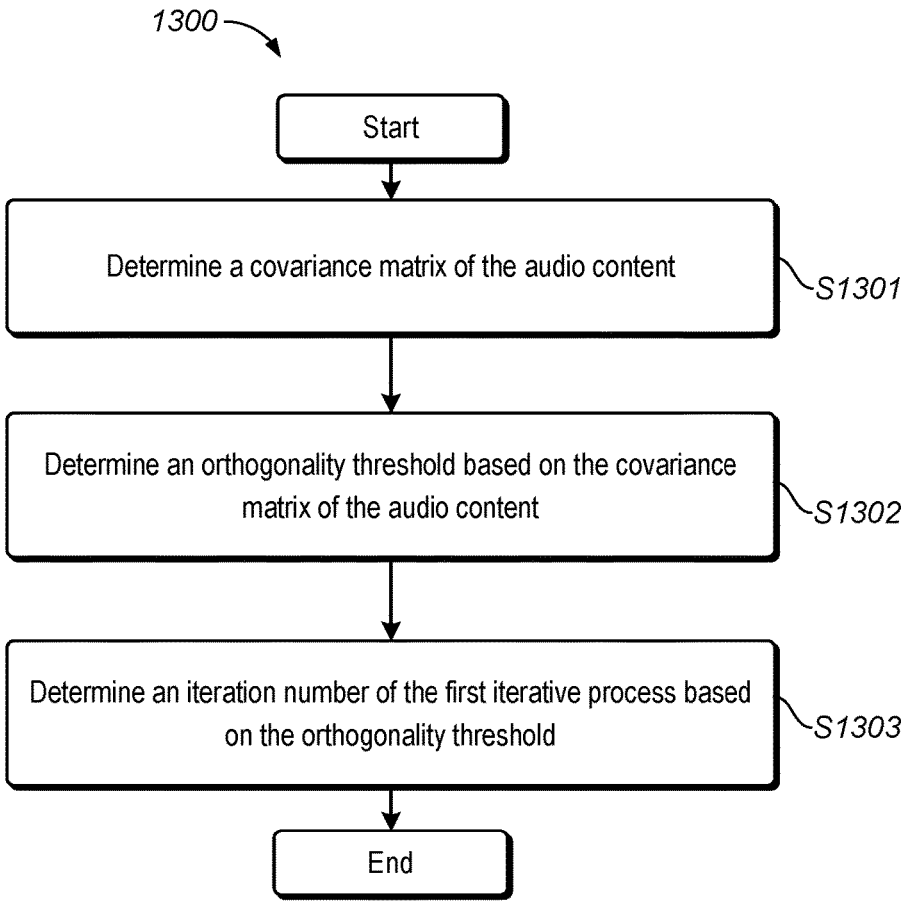
FIG. 13 illustrates a flowchart of a method for orthogonality control in accordance with an example embodiment disclosed herein.

FIG. 13 depicts a flowchart of a method 1300 for orthogonality control in accordance with an example embodiment disclosed herein.

At S1301, a covariance matrix of the audio content may be determined from the audio content. The covariance matrix of the audio content may be determined, for example, according to Equation (4).

The orthogonality of the input audio content may be measured by bias of the input signal. The bias of the input signal may indicate how close the input audio content is to being "unity-rank". For example, if the audio content as mixture signals is created by simply panning a single audio source, this signal may be unity-rank. If the mixture signals consist of uncorrelated noise or diffusive signals in each channel, it may have a rank I. If the mixture signals consist of a single object source plus a small amount of uncorrelated noise, it may also have a rank I but instead a measure may be needed to describe the signals as "close to being unity-rank." Generally, the closer to unity-rank the audio content is, the more confident/less-ambiguous for the joint determination to apply relatively thorough independent/uncorrelated restrictions. Typically, the NMF model can deal well with uncorrelated noise or diffusive signals, while the independent/uncorrelated model which is shown to work satisfactorily in signals "close to unity-rank" are prone to introduce over-correction in diffusive signals, resulting in scattered TF bins perceived as for example, musical noise.

One feature used for indicating the degree of "close to unity-rank" is called the purity of the covariance matrix $C_{X,fn}$ of the audio content. Therefore, in this embodiment, the covariance matrix $C_{X,fn}$ of the audio content may be calculated for controlling the orthogonality among the audio sources to be separated.

At S1302, an orthogonality threshold may be determined based on the covariance matrix of the audio content.

In an example embodiment, the covariance matrix $C_{X,fn}$ may be normalized as $C_{X,fn}$. In particular, the eigenvalues $\lambda_i$ (i=1, . . . , I) of the covariance matrix $C_{X,fn}$ may be normalized such that the sum of all eigenvalues is equal to 1. The purity of the covariance matrix may be determined by the sum of the squares of the eigenvalues, for example, by the Frobenius norm of the normalized covariance matrix as $\gamma=\Sigma_i=\lambda_i^2=\|\overline{C}_{X,fn}\|_F^2$. Herein, γ represents the purity of the covariance matrix $C_{X,fn}$.

The orthogonality threshold may be obtained by the lower-bound and the higher-bound for the purity. In some examples, the lower-bound for the purity occurs when all eigenvalues are equal, for example, γ=1/N, which indicates the most diffusive and ambiguous case. The higher-bound for the purity occurs when one eigenvalues is equal to one and all others are zero, for example, γ=1, which indicates the easiest and most confident case. The rank of $\overline{C}_{X,fn}$ is equal to the number of non-zero eigenvalues, so it makes sense to say that the purity feature can reflect the degree to which the energy is unfairly distributed among the latent components of the input audio content (the mixture signals).

To better scale the orthogonality threshold, another measure named bias of the input audio content may be further calculated based on the purity as below:

$$\Psi_X = \frac{I\cdot\gamma-1}{I-1} = \frac{I\cdot\|\overline{C}_{X,fn}\|_F^2-1}{I-1} \tag{20}$$

The bias $\Psi_X$ may vary from 0 to 1. $\Psi_X=0$ implies that the input audio content is totally diffuse, which further implies that less independent/uncorrelated restrictions should be applied in the joint determination. $\Psi_X=1$ implies that the audio content is unity-rank, and the bias $\Psi_X$ being closer to 1 implies that the audio content is closer to unity-rank. In these cases, more number of iterations in the independent/uncorrelated model may be set in the joint determination.

The method 1300 then proceeds to S1302, where an iteration number of the iterative process in the independent/uncorrelated model is determined based on the orthogonality threshold.

The orthogonality threshold may be used to set the iteration number of the iterative process in the independent/uncorrelated model (referring to the second iterative process described above, and Pseudo code 2 shown in FIG. 5) to control the orthogonality degree. In one example embodiment, a threshold for the iteration number may be determined based on the orthogonality threshold, so as to control the iterative process. In another embodiment, a threshold for the convergence may be determined based on the orthogonality threshold, so as to control the iterative process. The convergence of the iterative process in the independent/uncorrelated model may be determined as:

$$\sigma_{iter} = \frac{\|\hat{D}_{f,n}C_{X,fn}\hat{D}_{f,n}^H\|_F}{\|\hat{D}_{f,n}\|_F^2\cdot\|C_{X,fn}\|_F^2+\varepsilon} \tag{21}$$

In each iteration, if the convergence is less than the threshold, the iterative process ends.

In yet another example embodiment, a threshold for difference between two consecutive iterations may be set for the iterative process. The difference between two consecutive iterations may be represented as:

$$\nabla\sigma=\sigma_{iter-1}-\sigma_{iter} \tag{22}$$

If the difference between convergences of the previous iteration and the current iteration is less than the threshold, the iterative process ends.

In a still yet another example embodiment, two or more of thresholds for the iteration number, for the convergence, and for the difference between two consecutive iterations may be considered in the iterative process.

FIG. 14 depicts a schematic diagram of Pseudo code 3 for the parameter determination in the iterative process of FIG. 5 in accordance with an example embodiment disclosed herein. In the example embodiment, the count of iterations iter_Gradient, the threshold for convergence measurement thr_conv, and the threshold for difference between two consequent iterations thr_conv_diff may be determined based on the orthogonality threshold. All those parameters are used to guide the iterative process in the independent/uncorrelated model so as to control the orthogonality degree.

In the above description, the joint determination of the spatial parameter used for audio source separation is described. The joint determination may be implemented based on the additive model and the independent/uncorrelated model, such that audio sources with perceptually natural sounding as well as a proper mutual orthogonality degree may be obtained based on the final spatial parameters.

It should be appreciated that both independent/uncorrelated modeling methods and additive modeling methods have permutation ambiguity issues. That is, with respect to independent/uncorrelated modeling methods, the permutation ambiguity arises from the individual processing of each sub-band, which implicitly assumes mutual independence of one source's sub-bands. With respect to additive modeling methods (e.g., NMF), the separation of audio sources corresponding to the whole physical entities requires clustering the NMF components with respect to each individual source. The NMF components span over frequency, but due to their fixed spectrum over time they can only model simple audio objects/components which need to be further clustered.

In contrast, example embodiments disclosed herein, such as those depicted in FIGS. 7, 9, and 12, beneficially resolve this permutation alignment problem by jointly estimating the source spatial parameters and spectral parameters and thus coupling the frequency bands. This is based on the assumption that components originating from the same acoustic source share similar spatial covariance properties, as known as object source. Based on the consistency among the spatial coefficients, the proposed system in FIG. 3 may be used to associate both NMF components and by independent/uncorrelated modeled time-frequency bins to separate acoustic sources.

In the above description, the joint determination of the spatial parameters is described based on the additive model, for example, the NMF model, and the independent/uncorrelated mode for example, the adaptive de-correlation model.

One merit of the additive modeling, such as NMF modeling, is that the sum of models can be equal to sum of audio sounds, such as $W_{j,F\times(K1+K2)}\cdot H_{j,(K1+K2)\times N}=W_{j,F\times K1}\cdot H_{j,K1\times N}+W_{j,F\times K2}\cdot H_{j,K2\times N}$.

If input audio content is modeled as a sum of a set of elementary components by an additive source model, and the audio sources are generated by grouping the set of elementary components, then these sources may be indicated as "inner sources." If a set of audio sources are independently modeled by additive source models, these sources may be indicated as "outer sources", such as the audio sources separated in the above EM algorithm. Example embodiments disclosed herein provide the advantage in that they can impose refinement or constraints on: 1) both additive source models (e.g., NMF) and other models such as independent/uncorrelated models; and 2) not only to inner sources, but also to outer sources, so that the one source could be enforced to be independent/uncorrelated from another, or with adjustable degrees of orthogonality.

Therefore, audio sources with perceptually natural sounding as well as a proper mutual orthogonality degree may be obtained in example embodiments disclosed herein.

In some further example embodiments disclosed herein, in order to better extract the audio sources, the multi-channel audio content may be separated as multi-channel direct signals $<X_{f,n}>_{direct}$ and multi-channel ambiance signals $<X_{f,n}>_{ambiance}$. As used herein, the term "direct signal" refers to an audio signal generated by object sources that gives an impression to a listener that a heard sound has an apparent direction. The term "diffuse signal" refers to an audio signal that gives an impression to a listener that the heard sound does not have an apparent direction or is emanating from a lot of directions around the listener. Typically, a direct signal may be originated from a plurality of direct object sources panned among channels. A diffuse signal may be weakly correlated with the direct sound source and/or may be distributed across channels, such as an ambiance sound, reverberation, and the like.

Therefore, audio sources may be separated from the direct audio signal based on the jointly determined spatial parameters. In an example embodiment, the time-frequency domain of multi-channel audio source signals may be reconstructed using Wiener filtering as below:

$$\hat{s}_{f,n}=D_{f,n}(<X_{f,n}>_{direct}-b_{f,n}) \tag{23}$$

The parameter $D_{f,n}$ in Equation (23) may be given by Equation (10) in an underdetermined condition and by Equation (11) in an over-determined condition. Such a Wiener reconstruction is conservative in the sense that the extracted audio source signals and the additive noise sum up to the multi-channel direct signals $<X_{f,n}>_{direct}$ in the time-frequency domain.

It is noted that in the example embodiments of the joint determination, the source parameters including $D_{f,n}$ considered in the joint determination of the spatial parameters may still be generated on the basis of the original input audio content $X_{f,n}$ rather than on decomposed direct signals $<X_{f,n}>_{direct}$. Hence the source parameters obtained from the original input audio content may be decoupled from the decomposition algorithm and appear to be less prone to instability artifacts.

Figure 15:
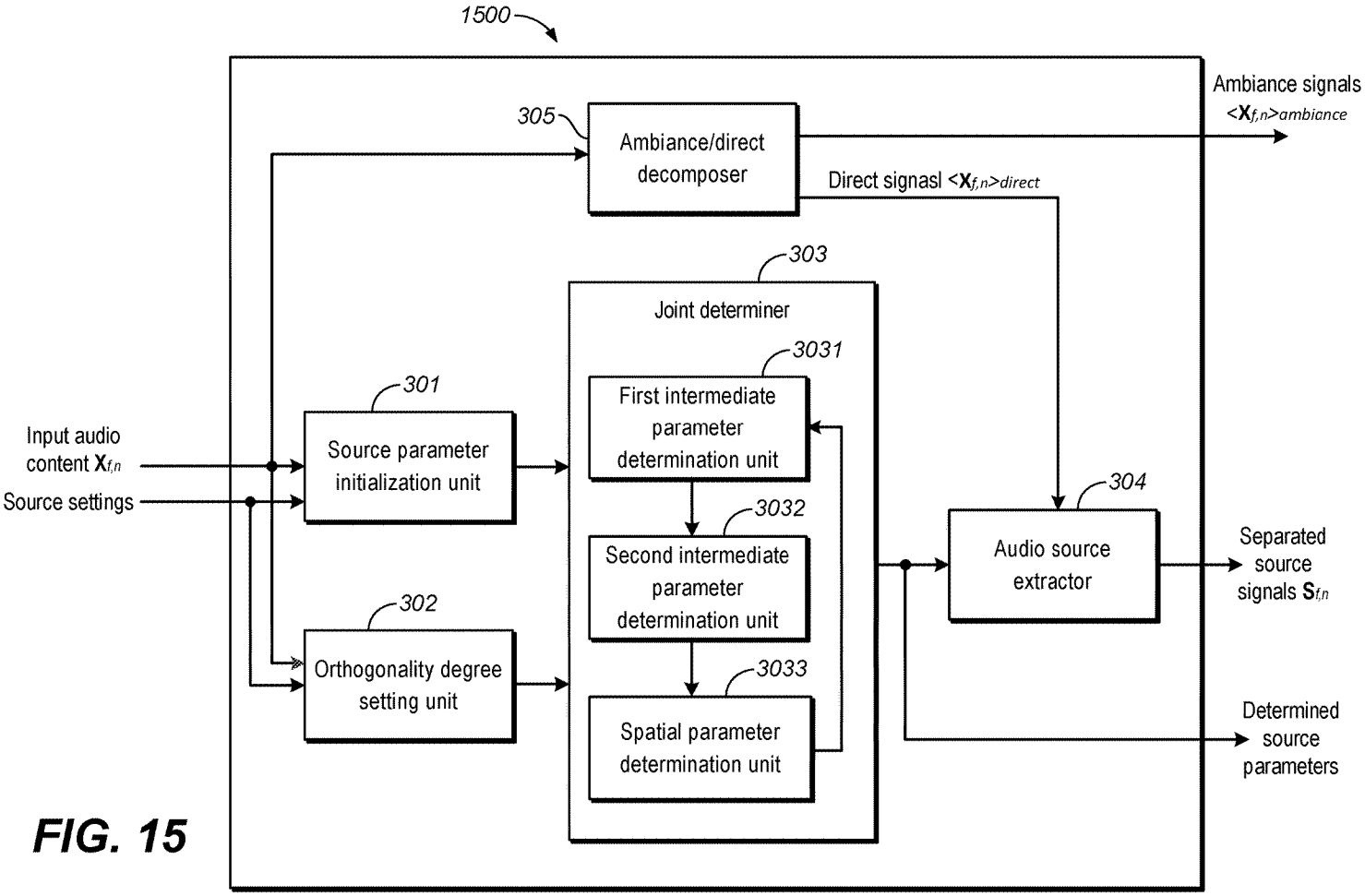
FIG. 15 illustrates a block diagram of a system of audio source separation in accordance with another example embodiment disclosed herein.

FIG. 15 depicts a block diagram of a system 1500 of audio source separation in accordance with another example embodiment disclosed herein. The system 1500 is an extension of the system 300 and includes an additional component, an ambiance/direct decomposer 305. The functionality of the components 301-303 in the system 1500 may be the same as described with reference to those in the system 300. In some example embodiments, the joint determiner 303 may be replaced by the one shown in FIG. 11.

The ambiance/direct decomposer 305 may be configured to receive the input audio content $X_{f,n}$ in time-frequency-domain representation, and to obtain multi-channel audio signals comprising ambiance signals $<X_{f,n}>_{ambiance}$ and direct signals $<X_{f,n}>_{direct}$. The ambiance signals $<X_{f,n}>_{ambiance}$ may be output by the system 1500 and the direct signals $<X_{f,n}>_{direct}$ may be provided to the audio source extractor 304.

The audio source extractor 304 may be configured to receive the time-frequency-domain representation of the direct signals $<X_{f,n}>_{direct}$ decomposed from the original input audio content and the determined spatial parameters, and to output separated audio source signals $s_{f,n}$.

Figure 16:
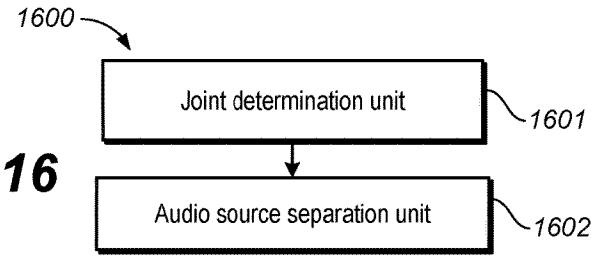
FIG. 16 illustrates a block diagram of a system of audio source separation in accordance with one example embodiment disclosed herein.

FIG. 16 depicts a block diagram of a system 1600 of audio source separation in accordance with one example embodiment disclosed herein. As depicted, the system 1600 comprises a joint determination unit 1601 configured to determine a spatial parameter of an audio source based on a linear combination characteristic of the audio source and an orthogonality characteristic of two or more audio sources to be separated in the audio content. The system 1600 also comprises an audio source separation unit 1602 configured to separate the audio source from the audio content based on the spatial parameter.

In some example embodiments, the number of the audio sources to be separated may be predetermined.

In some example embodiments, the joint determination unit 1601 may comprise a power spectrum determination unit configured to determine a power spectrum parameter of the audio source based on one of the linear combination characteristic and the orthogonality characteristic, a power spectrum updating unit configured to update the power spectrum parameter based on the other of the linear combination characteristic and the orthogonality characteristic, and a spatial parameter determination unit configured to determine the spatial parameter of the audio source based on the updated power spectrum parameter.

In some example embodiments, the joint determination unit 1601 may be further configured to determine a spatial parameter of an audio source in an expectation maximization (EM) process. In these embodiments, the system 1600 may further comprise an initialization unit configured to set initialized values for the spatial parameter and a spectral parameter of the audio source before beginning of the EM iterative process, the initialized value for the spectral parameter is non-negative.

In some example embodiments, in the joint determination unit 1601, for each EM iteration in the EM iterative process, the power spectrum determination unit may be configured to determine, based on the linear combination characteristic, the power spectrum parameter of the audio source by using the spectral parameter of the audio source determined in a previous EM iteration, the power spectrum updating unit may be configured to update the power spectrum parameter of the audio source based on the orthogonality characteristic, and the spatial parameter determination unit may be configured to update the spatial parameter and the power spectrum parameter of the audio source based on the updated power spectrum parameter.

In some example embodiments, in the joint determination unit 1601, for each EM iteration in the EM iterative process, the power spectrum determination unit may be configured to determine, based on the orthogonality characteristic, the power spectrum parameter of the audio source by using the spatial parameter and the spectral parameter determined in a previous EM iteration, the power spectrum updating unit may be configured to update the power spectrum parameter of the audio source based on the linear combination characteristic, and the spatial parameter determination unit may be configured to update the spatial parameter and the power spectrum parameter of the audio source based on the updated power spectrum parameter.

In some example embodiments, the spatial parameter determination unit may be configured to determine, based on the orthogonality characteristic, the power spectrum parameter of the audio source by using the initialized values for the spatial parameter and the spectral parameter before the beginning of the EM iterative process. In these embodiments, for each EM iteration in the EM iterative process, the power spectrum updating unit may be configured to update, based on the linear combination characteristic, the power spectrum parameter of the audio source by using the spectral parameter determined in a previous EM iteration, and the spatial parameter determination unit may be configured to update the spatial parameter and the power spectrum parameter of the audio source based on the updated power spectrum parameter.

In some example embodiments, the spectral parameter of the audio source may be modeled by a non-negative matrix factorization model.

In some example embodiments, the power spectrum parameter of the audio source may be determined or updated based on the linear combination characteristic by decreasing an estimation error of a covariance matrix of the audio source in a first iterative process.

In some example embodiments, the system 1600 may further comprise a covariance matrix determination unit configured to determine a covariance matrix of the audio content, an orthogonality threshold determination unit configured to determine an orthogonality threshold based on the covariance matrix of the audio content, and an iteration number determination unit configured to determine an iteration number of the first iterative process based on the orthogonality threshold.

In some example embodiments, at least one of the spatial parameter or the spectral parameter may be normalized before each EM iteration.

In some example embodiments, the joint determination unit 1601 may be further configured to determine the spatial parameter of the audio source based on one or more of mobility of the audio source, stability of the audio source, or a mixing type of the audio source.

In some example embodiments, the audio source separation unit 1602 may be configured to extract a direct audio signal from the audio content, and separate the audio source from the direct audio signal based on the spatial parameter.

For the sake of clarity, some additional components of the system 1600 are not depicted in FIG. 16. However, it should be appreciated that the features as described above with reference to FIGS. 1-15 are all applicable to the system 1600. Moreover, the components of the system 1600 may be a hardware module or a software unit module and the like. For example, in some example embodiments, the system 1600 may be implemented partially or completely with software and/or firmware, for example, implemented as a computer program product embodied in a computer readable medium. Alternatively or additionally, the system 1600 may be implemented partially or completely based on hardware, for example, as an integrated circuit (IC), an application-specific integrated circuit (ASIC), a system on chip (SOC), a field programmable gate array (FPGA), and so forth.

Figure 17:
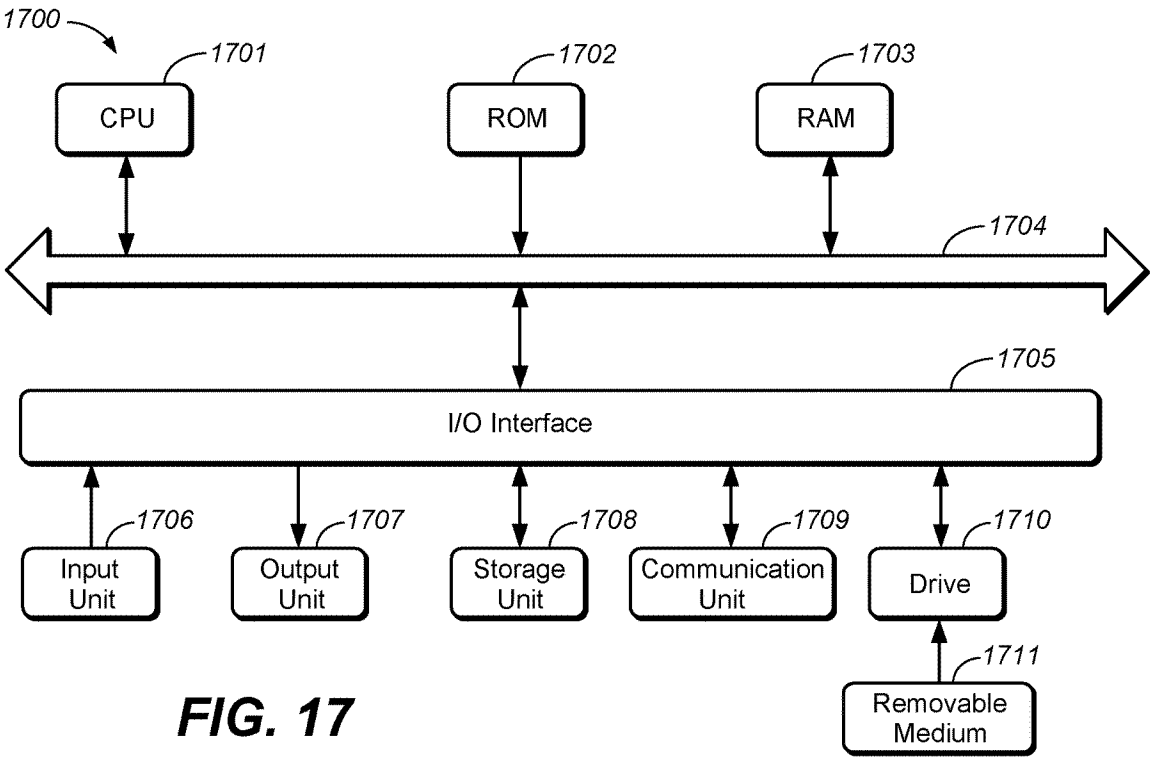
FIG. 17 illustrates a block diagram of an example computer system suitable for implementing example embodiments disclosed herein.

FIG. 17 depicts a block diagram of an example computer system 1700 suitable for implementing example embodiments disclosed herein. As depicted, the computer system 1700 comprises a central processing unit (CPU) 1701 which is capable of performing various processes in accordance with a program stored in a read only memory (ROM) 1702 or a program loaded from a storage section 1708 to a random access memory (RAM) 1703. In the RAM 1703, data required when the CPU 1701 performs the various processes or the like is also stored as required. The CPU 1701, the ROM 1702 and the RAM 1703 are connected to one another via a bus 1704. An input/output (I/O) interface 1705 is also connected to the bus 1704.

The following components are connected to the I/O interface 1705: an input section 1706 including a keyboard, a mouse, or the like; an output section 1707 including a display such as a cathode ray tube (CRT), a liquid crystal display (LCD), or the like, and a loudspeaker or the like; the storage section 1708 including a hard disk or the like; and a communication section 1709 including a network interface card such as a LAN card, a modem, or the like. The communication section 1709 performs a communication process via the network such as the internet. A drive 1710 is also connected to the I/O interface 1705 as required. A removable medium 1711, such as a magnetic disk, an optical disk, a magneto-optical disk, a semiconductor memory, or the like, is mounted on the drive 1710 as required, so that a computer program read therefrom is installed into the storage section 1708 as required.

Specifically, in accordance with example embodiments disclosed herein, the processes described above with reference to FIGS. 1-15 may be implemented as computer software programs. For example, example embodiments disclosed herein comprise a computer program product including a computer program tangibly embodied on a machine readable medium, the computer program including program code for performing methods or processes 100, 200, 600, 800, 1000, and/or 1300, and/or processing described with reference to the systems 300, 1500, and/or 1600. In such embodiments, the computer program may be downloaded and mounted from the network via the communication section 1709, and/or installed from the removable medium 1711.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server. The program code may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms.

As used in this application, the term "circuitry" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of the subject matter disclosed herein or of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments disclosed herein may become apparent to those skilled in the relevant arts in view of the foregoing description, when read in conjunction with the accompanying drawings. Any and all modifications will still fall within the scope of the non-limiting and example embodiments disclosed herein. Furthermore, other embodiments disclosed herein will come to mind to one skilled in the art to which these embodiments pertain having the benefit of the teachings presented in the foregoing descriptions and the drawings.

Accordingly, the subject matter may be embodied in any of the forms described herein. For example, the following enumerated example embodiments (EEEs) describe some structures, features, and functionalities of some aspects disclosed herein.

EEE 1. An apparatus for separating audio sources on the basis of a time-frequency-domain input audio signal, the time-frequency-domain representation representing the input audio signal in terms of a plurality of sub-band signals describing a plurality of frequency bands, the apparatus comprising a joint source separator configured to combine a plurality of source parameters, the plurality of source parameters comprising of principle parameters estimated for recovering the audio sources and intermediate parameters for refining the principle parameters, such that the joint source separator recovers perceptually natural sounding sources while enabling a stable and rapid convergence on the basis of the refined parameters. The apparatus also comprises a first determiner configured to estimate the principle parameters, such that spectral information about unseen sources in the input audio signal, and/or information describing the spatiality or mixing process of the unseen sources present in the input audio signal are obtained. The apparatus further comprises a second determiner configured to obtain the intermediate parameters, such that information for refining the spectral properties, spatiality and/or mixing process of the unseen sources in the input audio is obtained.

EEE 2. The apparatus according to EEE 1 further comprises an orthogonality degree determiner configured to obtain a coefficient factor such that degrees of orthogonality control among audio sources are obtained on the basis of the input audio signal, the coefficient factor including a plurality of quantitative feature values indicating the orthogonality properties among the sources. The joint source separator is configured to receive the orthogonality degree from the orthogonality degree determiner to control the combination of the plurality of source parameters, to obtain audio sources with perceptually natural sounding as well as proper mutual orthogonality degree determined by the orthogonality degree determiner based on the properties of the input audio signal.

EEE 3. The apparatus according to EEE 1, wherein the first determiner is configured to estimate the principle parameters on the basis of the time-frequency-domain representation of the input audio signal by applying an additive source model, so as to recover perceptually natural sounds EEE 4. The apparatus according to EEE 3, wherein the additive source model is configured to use a Non-negative Matrix Factorization method to decompose a non-negative time-frequency-domain representation of an estimated audio source into a sum of elementary components, such that the principle spectral parameters are represented in the representation of a product of non-negative matrices, which non-negative matrices including one non-negative matrix with spectral components as column vectors such that spectral constraints can be applied, and one non-negative matrix with activation of each spectrum components as row vectors on such that temporal constraints can be applied.

EEE 5. The apparatus according to EEE 1, wherein the plurality of source parameters include spatial parameters and spectral parameters, such that the permutation ambiguity is eliminated by coupling the spectral parameters to separated audio sources on the basis of their spatial parameters.

EEE 6. The apparatus according to EEE 1, wherein the second determiner is configured to use an adaptive decorrelation model such that independent/uncorrelated constraints are applied for refining the principle parameters.

EEE 7. The apparatus according to any one of EEEs 1 and 6, wherein the second determiner is configured to apply the independent/uncorrelated constraints by minimizing the measurement error $E_{f,n}$ between an estimation and a perfect covariance matrix, such that the refined parameters including at least one of spatial parameters and spectral parameters are refined as $\hat{C}_{S,fn}, \hat{D}_{f,n}=\mathrm{argmin}_{C_{S,fn},D_{f,n}}\|E_{f,n}\|_F^2$.

EEE 8. The apparatus according to EEE 7, wherein the measurement error is minimized by applying a gradient method and the gradient terms are normalized by the powers to scale the gradient to give comparable update steps for different frequencies.

EEE 9. The apparatus according to EEE 1, wherein the joint source separator is configured to combine the two determiners to jointly estimate the spectral parameters and the spatial parameters of the audio sources inside an EM algorithm, of which one iteration comprising an Expectation step and a Maximization step:

for an Expectation step:

calculating intermediate spectral parameters including at least the power spectrogram of the sources, on the basis of the estimated principle spectral parameters modeled by the first determiner, calculating intermediate spatial parameters including at least inverse mixing parameters, for example, Wiener filter parameters, on the basis of the estimated spectral parameters and the estimated principle spatial parameters of the sources, refining the intermediate spatial and spectral parameters with source models of the second determiner, the parameters including at least one of the Wiener filter parameters, the covariance matrix of the audio sources, and the power spectrogram of the audio sources, on the basis of the above estimated intermediate parameters, and calculating other intermediate parameters on the basis of the refined parameters, the other intermediate parameters including at least the cross covariance matrices between the input audio signal and the estimated source signals; and for a Maximization step, re-estimating the principle parameters including the principle spectral parameters and the principle spatial parameters (mixing parameters), on the basis of the refined intermediate parameters, and re-normalizing the principle parameters, such that the trivial scale indeterminacies are eliminated.

EEE 10. A source generator apparatus for extracting a plurality of audio source signals and their parameters on the basis of one or more input audio signals, the apparatus is configured to receive an input audio in time-frequency-domain representation and a set of source settings. The apparatus is also configured to initialize the source parameters, based on a set of source settings and a subtraction signal generated from the input audio subtracting an estimated additive noise, and to obtain a set of initialized source parameters, the set of source settings including but not limited to initial source number, source mobility, source stability, audio mixing class, spatial guidance metadata, user guidance metadata, and Time-Frequency guidance metadata. The apparatus is further configured to jointly separate the audio sources, based on the initialized source parameters received, and to output the separated sources and their corresponding parameters until the iterative separation procedure converges. Each step of the iterative separation procedure further comprises estimating principle parameters based on an additive model, with the initialized and/or refined intermediate parameters received, estimating intermediate parameters and refining these parameters based on an independent/uncorrelated model, and recovering the separated object source signals on the basis of the estimated source parameters and the input audio in time-frequency-domain representation.

EEE 11. The apparatus according to EEE 10, wherein the step for jointly separating the sources further comprises determining the orthogonality degrees of the unseen sources, based on the said input signal and the set of source settings received, obtaining quantitative degrees of orthogonality control among sources, jointly separating the audio sources based on the initialized source parameters and the orthogonality control degree received, and outputting the separated sources and their corresponding parameters until the iterative separation procedure converges. Each step of the iterative separation procedure further comprises estimating principle parameters based on an additive model with the initialized and/or refined intermediate parameters received, and estimating intermediate parameters and refining these parameters based on an independent/uncorrelated model with the orthogonality control degree received.

EEE 12. A multi-channel audio signal generator apparatus for providing a multi-channel audio signal comprising at least one object signal on the basis of one or more input audio signal, the apparatus is configured to receive an input audio in time-frequency-domain representation and a set of source settings, initialize the source parameters, with a set of source settings and a subtraction signal generated from the input audio subtracting an estimated additive noise received, and to obtain a set of initialized source parameters, the set of source settings including but not limited to one of initial source number, source mobility, source stability, audio mixing class, spatial guidance metadata, user guidance metadata, and Time-Frequency guidance metadata. The apparatus is also configured to determine the orthogonality degrees of the unseen sources, with the said input signal and the set of source settings received, and to obtain quantitative degrees of orthogonality control among sources. The apparatus is further configured to jointly separate the sources, with the initialized source parameters and the orthogonality control degree received, and to output the separated sources and their corresponding parameters until the iterative separation procedure converges. Each step of the iterative separation procedure further comprises estimating principle parameters based on an additive model, with the initialized and/or refined intermediate parameters received, and estimating intermediate parameters and refining these parameters based on an independent/uncorrelated model, with the orthogonality control degree received. The apparatus is further configured to decompose the input audio into multi-channel audio signals comprising ambiance signals and direct signals, and to extract separated object source signals on the basis of the estimated source parameters and the decomposed direct signals in time-frequency-domain representation.

EEE 13. The apparatus according to EEE 12, wherein jointly separating the sources further comprises: determining the orthogonality degrees of the unseen sources, with the said input signal and the set of source settings received, obtaining quantitative degrees of orthogonality control among sources, jointly separating the sources with the initialized source parameters and the orthogonality control degree received, and outputting the separated sources and their corresponding parameters until the iterative separation procedure converges. Each step of the iterative separation procedure further comprises estimating principle parameters based on an additive model, with the initialized and/or refined intermediate parameters received, and estimating intermediate parameters and refining these parameters based on an independent/uncorrelated model, with the orthogonality control degree received.

EEE 14. A source parameter estimation apparatus for refining source parameters with an independent/uncorrelated model to ensure rapid and stable convergence of estimation for the source parameters under other models, with a set of initialized source parameters received, the re-estimation problem being solved as a least square (LS) estimation problem such that the set of parameters are re-estimated to minimize the measurement error between the conditional expectation of covariance matrices calculated with the current parameters and the ideal covariance matrices with the independent/uncorrelated model.

EEE 15. The apparatus according to EEE 14, wherein the least square (LS) estimation problem is solved with a gradient descent algorithm with an iterative procedure, and each iteration comprises calculating the gradient descent value by minimizing the measurement error between the conditional expectation of covariance matrices calculated with the current parameters and the ideal covariance matrices with the independent/uncorrelated model, updating the source parameters using the gradient descent value, and calculating convergence measurements, such that if it reaches a convergence threshold, the iteration breaks and the updated source parameters are output.

EEE 16. The apparatus according to EEE 14, wherein the apparatus further comprises a determiner for setting orthogonality degree among the estimated sources such that they are pleasant sounding sources despite of certain acceptable amount of correlation between them.

EEE 17. The apparatus according to EEE 16, wherein the determiner determines the orthogonality degree using content-adaptive measure including, but not limited to, a quantitative measure (bias), which implies to what degree the input audio signal is "close to unity-rank", such that the closer to unity-rank the audio signal is, the more confident/less-ambiguous the independent/uncorrelated restrictions are applied thoroughly.

It will be appreciated that the example embodiments disclosed herein are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method of audio source separation from audio content, the method comprising:

determining a spatial parameter of an audio source, wherein the determining comprises:

determining a power spectrum parameter of the audio source based on one of a linear combination characteristic of the audio source and an orthogonality characteristic of two or more audio sources to be separated in the audio content;

updating the power spectrum parameter based on the other of the linear combination characteristic and the orthogonality characteristic; and determining the spatial parameter of the audio source based on the updated power spectrum parameter; and separating the audio source from the audio content based on the spatial parameter.

2. The method according to claim 1, wherein the determining a spatial parameter of the audio source further comprises determining the spatial parameter of the audio source in an expectation maximization (EM) iterative process; and wherein the method further comprises:

setting initialized values for the spatial parameter and a spectral parameter of the audio source before beginning of the EM iterative process, the initialized value for the spectral parameter is non-negative.

3. The method according to claim 2, wherein the determining the spatial parameter of the audio source in the EM iterative process comprises, for each EM iteration in the EM iterative process:

determining, based on the orthogonality characteristic, the power spectrum parameter of the audio source by using the spatial parameter and the spectral parameter of the audio source determined in a previous EM iteration;

updating the power spectrum parameter of the audio source based on the linear combination characteristic; and updating the spatial parameter and the spectral parameter of the audio source based on the updated power spectrum parameter.

4. The method according to claim 2, further comprising:

determining, based on the orthogonality characteristic, the power spectrum parameter of the audio source by using the initialized values for the spatial parameter and the spectral parameter before the beginning of the EM iterative process; and wherein the determining a spatial parameter of an audio source in an EM iterative process comprises, for each EM iteration in the EM iterative process:

updating, based on the linear combination characteristic, the power spectrum parameter of the audio source by using the spectral parameter of the audio source determined in a previous EM iteration, and updating the spatial parameter and the spectral parameter of the audio source based on the updated power spectrum parameter.

5. The method according to claim 2, wherein the determining a spatial parameter of an audio source in an EM iterative process comprises, for each EM iteration in the EM iterative process:

determining, based on the linear combination characteristic, the power spectrum parameter of the audio source by using the spectral parameter of the audio source determined in a previous EM iteration;

updating the power spectrum parameter of the audio source based on the orthogonality characteristic; and updating the spatial parameter and the spectral parameter of the audio source based on the updated power spectrum parameter.

6. The method according to claim 5, wherein the spectral parameter of the audio source is modeled by a non-negative matrix factorization model.

7. The method according to claim 5, wherein at least one of the spatial parameter or the spectral parameter is normalized before each EM iteration.

8. The method according to claim 5, wherein the determination of the spatial parameter of the audio source is further based on one or more of mobility of the audio source, stability of the audio source, or a mixing type of the audio source.

9. The method according to claim 5, wherein the power spectrum parameter of the audio source is determined or updated based on the linear combination characteristic by decreasing an estimation error of a covariance matrix of the audio source in a first iterative process.

10. The method according to claim 9, further comprising:

determining a covariance matrix of the audio content;

determining an orthogonality threshold based on the covariance matrix of the audio content; and determining an iteration number of the first iterative process based on the orthogonality threshold.

11. The method according to claim 1, wherein the separating the audio source from the audio content based on the spatial parameter comprises:

extracting a direct audio signal from the audio content; and separating the audio source from the direct audio signal based on the spatial parameter.

12. A computer program product of audio source separation from audio content, the computer program product being tangibly stored on a non-transitory computer-readable medium and comprising machine executable instructions which, when executed, cause the machine to perform steps of the method according to claim 1.

13. A system of audio source separation from audio content, the system comprising:

a joint determination unit configured to determine a spatial parameter of an audio source, the joint determination unit comprising:

a power spectrum determination unit configured to determine a power spectrum parameter of the audio source based on a linear combination characteristic of the audio source and an orthogonality characteristic of two or more audio sources to be separated in the audio content;

a power spectrum updating unit configured to update the power spectrum parameter based on the other of the linear combination characteristic and the orthogonality characteristic; and a spatial parameter determination unit configured to determine the spatial parameter of the audio source based on the updated power spectrum parameter; and an audio source separation unit configured to separate the audio source from the audio content based on the spatial parameter.

14. The system according to claim 13, wherein the joint determination unit is further configured to determine the spatial parameter of the audio source in an expectation maximization (EM) iterative process; and wherein the system further comprises:

an initialization unit configured to set initialized values for the spatial parameter and a spectral parameter of the audio source before beginning of the EM iterative process, the initialized value for the spectral parameter is non-negative.

15. The system according to claim 14, wherein in the joint determination unit, for each EM iteration in the EM iterative process, the power spectrum determination unit is configured to determine, based on the orthogonality characteristic, the power spectrum parameter of the audio source by using the spatial parameter and the spectral parameter of the audio source determined in a previous EM iteration, the power spectrum updating unit is configured to update the power spectrum parameter of the audio source based on the linear combination characteristic, and the spatial parameter determination unit is configured to update the spatial parameter and the power spectrum parameter of the audio source based on the updated power spectrum parameter.

16. The system according to claim 14, wherein the power spectrum determination unit is configured to determine, based on the orthogonality characteristic, the power spectrum parameter of the audio source by using the initialized values for the spatial parameter and the spectral parameter before the beginning of the EM iterative process; and wherein for each EM iteration in the EM iterative process, the power spectrum updating unit is configured to update, based on the linear combination characteristic, the power spectrum parameter of the audio source by using the spectral parameter of the audio source determined in a previous EM iteration, and the spatial parameter determination unit is configured to update the spatial parameter and the power spectrum parameter of the audio source based on the updated power spectrum parameter.

17. The system according to claim 14, wherein in the joint determination unit, for each EM iteration in the EM iterative process, the power spectrum determination unit is configured to determine, based on the linear combination characteristic, the power spectrum parameter of the audio source by using the spectral parameter of the audio source determined in a previous EM iteration, the power spectrum updating unit is configured to update the power spectrum parameter of the audio source based on the orthogonality characteristic, and the spatial parameter determination unit is configured to update the spatial parameter and the power spectrum parameter of the audio source based on the updated power spectrum parameter, wherein the spectral parameter of the audio source is modeled by a non-negative matrix factorization model.

18. The system according to claim 17, wherein the spectral parameter of the audio source is modeled by a non-negative matrix factorization model.

19. The system according to claim 17, wherein at least one of the spatial parameter or the spectral parameter is normalized before each EM iteration.

20. The system according to claim 17, wherein the power spectrum parameter of the audio source is determined or updated based on the linear combination characteristic by decreasing an estimation error of a covariance matrix of the audio source in a first iterative process.

21. The system according to claim 20, further comprising:

a covariance matrix determination unit configured to determine a covariance matrix of the audio content;

an orthogonality threshold determination unit configured to determine an orthogonality threshold based on the covariance matrix of the audio content; and an iteration number determination unit configured to determine an iteration number of the first iterative process based on the orthogonality threshold.

22. The system according to claim 13, wherein the joint determination unit is further configured to determine the spatial parameter of the audio source based on one or more of mobility of the audio source, stability of the audio source, or a mixing type of the audio source and the audio source separation unit is configured to extract a direct audio signal from the audio content, and separate the audio source from the direct audio signal based on the spatial parameter.

* * * * *